US010011787B2

(12) United States Patent
Lyon et al.

(10) Patent No.: US 10,011,787 B2
(45) Date of Patent: Jul. 3, 2018

(54) PRODUCTION OF LUBRICANT BASE STOCKS WITH CONTROLLED AROMATIC CONTENTS

(71) Applicants: Kristen S. Lyon, Humble, TX (US); Eric D. Joseck, Burke, VA (US); Gary P. Schleicher, Milford, NJ (US); Richard C. Dougherty, Moorestown, NJ (US); Angela Horton, Mantua, NJ (US)

(72) Inventors: Kristen S. Lyon, Humble, TX (US); Eric D. Joseck, Burke, VA (US); Gary P. Schleicher, Milford, NJ (US); Richard C. Dougherty, Moorestown, NJ (US); Angela Horton, Mantua, NJ (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 332 days.

(21) Appl. No.: 14/940,603

(22) Filed: Nov. 13, 2015

(65) Prior Publication Data

US 2016/0145512 A1 May 26, 2016

Related U.S. Application Data

(60) Provisional application No. 62/082,316, filed on Nov. 20, 2014.

(51) Int. Cl.
*C10G 69/02* (2006.01)
*C10M 101/00* (2006.01)
(Continued)

(52) U.S. Cl.
CPC ..... *C10G 69/02* (2013.01); *C10G 45/02* (2013.01); *C10G 45/58* (2013.01); *C10G 47/00* (2013.01);
(Continued)

(58) Field of Classification Search
CPC ..... C10G 69/02; C10G 65/12; C10G 67/04; C10G 65/04; C10G 47/00; C10G 45/58;
(Continued)

(56) References Cited

U.S. PATENT DOCUMENTS 6,569,312 B1 5/2003 Carroll et al.
8,658,018 B2 2/2014 Rosenbaum et al.
(Continued)

FOREIGN PATENT DOCUMENTS

GB 2407100 A 4/2005
WO 2006/055500 A1 5/2006

OTHER PUBLICATIONS

The International Search Report and Written Opinion of PCT/US2015/060604 dated Feb. 12, 2016.

*Primary Examiner* — Randy Boyer
*Assistant Examiner* — Juan C Valencia
(74) *Attorney, Agent, or Firm* — Scott F. Yarnell

(57) ABSTRACT

Methods are provided for producing Group II and Group III base stocks with a controlled or consistent aromatics content. An aromatics-rich base stock, such as a Group I base stock or an alkylated aromatic base stock, can be added to the catalytically treated base stock in a minimal amount after the final catalytic treatment step but prior to fractionation. At the beginning of a processing run for forming lubricant base stock products, about 0.25 wt % to about 1.25 wt % of the Group I base stock can be added to a catalytically processed feed after the final catalytic processing stage but prior to fractionation to form the Group II and/or Group III base
(Continued)

stock. During the course of the processing run, the amount of Group I base stock added can be reduced roughly in correspondence with the increase in aromatics caused by catalyst deactivation. This can allow a catalytically processed lubricant base stock product to be generated that contains at least about a threshold (minimum) aromatics content during the course of a processing run. Alternatively, this can allow a catalytically processed lubricant base stock product to be generated that has consistent aromatics content during the course of the processing run.

19 Claims, 6 Drawing Sheets

(51) Int. Cl.

| | |
|---|---|
| ***C10M 101/02*** | (2006.01) |
| ***C10G 45/02*** | (2006.01) |
| ***C10G 45/58*** | (2006.01) |
| ***C10G 47/00*** | (2006.01) |
| ***C10G 65/04*** | (2006.01) |
| ***C10G 65/12*** | (2006.01) |
| ***C10G 67/04*** | (2006.01) |

(52) U.S. Cl.
CPC ..... *C10G 65/04* (2013.01); *C10G 65/12* (2013.01); *C10G 67/04* (2013.01); *C10M 101/00* (2013.01); *C10M 101/02* (2013.01); *C10G 2400/10* (2013.01); *C10M 2203/1006* (2013.01); *C10M 2203/1045* (2013.01); *C10M 2205/223* (2013.01); *C10N 2220/022* (2013.01); *C10N 2230/43* (2013.01)

(58) Field of Classification Search
CPC .. C10G 45/02; C10G 2400/10; C10M 101/00; C10M 101/02; C10M 2205/223; C10M 2203/1045; C10M 2203/1006; C10N 2230/43; C10N 2220/022
See application file for complete search history.

(56) References Cited

U.S. PATENT DOCUMENTS

| | | | | |
|---|---|---|---|---|
| 2005/0133407 | A1 | 6/2005 | Abernathy et al. | |
| 2005/0258078 | A1 | 11/2005 | Rosenbaum et al. | |
| 2013/0264246 | A1* | 10/2013 | Holtzer ..... | C10G 65/12 208/19 |
| 2015/0027925 | A1* | 1/2015 | Joseck ..... | C10G 65/00 208/80 |

* cited by examiner

| | Units | ASTM Test Method | Group II LN | Group I LN A | Group I LN B | Group I HN A | Group I HN B |
|---|---|---|---|---|---|---|---|
| Color (ASTM) | - | D1500 | 0 | 1.0 | 0.5 | L1.0 | 1.0 |
| Color (Saybolt) | - | D6045 | > 30 | < -16 | 3 | <-16 | <-16 |
| KV at 100°C | cSt | D445 | 4.593 | 5.235 | 5.1755 | 12.34 | 12.09 |
| VI | - | D2270 | 117 | 101 | 96 | 96 | 96 |
| Pour Point | °C | D97 | -18 | -15 | -15 | -9 | -3 |
| CCS at -25°C | mPa•s | D5293 | 1320 | 3860 | n/a | 80140 | n/a |
| Emulsion at 54°C (to 3 ml) | min | D1401 | 5 | n/a | n/a | n/a | n/a |
| Sulfur | ppmw | D2622 | < 3 | 3608 | 2228 | 5720 | 3906 |
| UV Absorbance at 226 nm | L/g cm | - | 0.01 | 6.05 | 4.60 | 6.62 | 6.83 |

FIG. 2

| | Test Method (ASTM) | | | | | | | |
|---|---|---|---|---|---|---|---|---|
| Group II LN | | 100.0 | 99.5 | 99.5 | 99.0 | 99.1 | 99.5 | 99.25 |
| Group I LN A | | | 0.5 | | | | | |
| Group I LN B | | | | 0.5 | 1.0 | | | |
| Group I HN A | | | | | | 0.9 | 0.5 | |
| Group I HN B | | | | | | | | 0.75 |
| | | | | | | | | |
| Color (ASTM) | D1500 | 0 | 0 | 0 | 0 | 0 | 0 | 0 |
| Color (Saybolt) | D6045 | >30 | >30 | 30 | >30 | 28 | 30 | 28 |
| KV at 100°C (cSt) | D445 | 4.593 | 4.573 | 4.569 | 4.574 | 4.623 | 4.603 | 4.613 |
| Viscosity Index | D2270 | 117 | 116 | 116 | 116 | 117 | 117 | 117 |
| Pour Point (°C) | D97 | -18 | -15 | -15 | -18 | -15 | -15 | -15 |
| CCS at -25°C (mPa-s) | D5293 | 1320 | 1310 | 1300 | 1320 | 1330 | 1300 | 1320 |
| Emulsion at 54°C (to 3 ml) (min) | D1401 | 5 | 5 | 5 | 5 | 5 | 5 | 5 |
| Sulfur (ppmw) | D2622 | <3 | 20 | 13 | 24 | 54 | 31 | 32 |
| UV Absorbance at 226 nm (L/g cm) | | 0.01 | 0.04 | 0.04 | 0.06 | 0.05 | 0.07 | 0.06 |
| | | | | | | | | |

FIG. 3

| | Test Method (ASTM) | | | | | | | |
|---|---|---|---|---|---|---|---|---|
| Group II LN | | 83.21 | 82.71 | 82.71 | 82.21 | 82.31 | 82.71 | 82.46 |
| Group I LN A | | | 0.5 | | | | | |
| Group I LN B | | | | 0.5 | 1.0 | | | |
| Group I HN A | | | | | | 0.9 | 0.5 | |
| Group I HN B | | | | | | | | 0.75 |
| Additives | | 16.79 | 16.79 | 16.79 | 16.79 | 16.79 | 16.79 | 16.79 |
| | | | | | | | | |
| KV at 100°C (cSt) | D445 | 10.04 | 10.02 | 10.05 | 10.01 | 10.07 | 10.04 | 10.05 |
| Pour Point (°C) | D97 | -42 | -42 | -42 | -39 | -39 | -39 | -36 |
| CCS at -25°C (mPa-s) | D5293 | 3840 | 3900 | 3930 | 3940 | 4030 | 3790 | 3920 |
| MRV at -35°C Viscosity (mPa-s) | D4684 | 12000 | 12200 | 12100 | 11600 | 12600 | 12200 | 12800 |
| MRV at -35°C yield stress (Pa) | D4684 | <35 | <35 | <35 | <35 | <35 | <35 | <35 |
| HTHS at 150°C (mPa-s) | D4683 | 2.931 | 2.906 | 2.938 | 2.946 | 2.950 | 2.930 | 2.939 |
| Gel index | D5133 | 7.5 | 6.7 | 6.6 | 6.7 | 7.5 | 6.9 | 7.9 |
| | | | | | | | | |
| | | | | | | | | |

FIG. 4

| | Test Method (ASTM) | | | | | | | |
|---|---|---|---|---|---|---|---|---|
| Group II LN | | 72.37 | 71.87 | 71.87 | 71.37 | 71.47 | 71.87 | 71.62 |
| Group I LN A | | | 0.5 | | | | | |
| Group I LN B | | | | 0.5 | 1.0 | | | |
| Group I HN A | | | | | | 0.9 | 0.5 | |
| Group I HN B | | | | | | | | 0.75 |
| CoBase | | 27.0 | 27.0 | 27.0 | 27.0 | 27.0 | 27.0 | 27.0 |
| Additives | | 0.63 | 0.63 | 0.63 | 0.63 | 0.63 | 0.63 | 0.63 |
| | | | | | | | | |
| KV at 40°C (cSt) | D445 | 31.49 | 31.53 | 31.55 | 31.60 | 31.96 | 31.75 | 31.84 |
| RPVOT (min) | D2272 | 1183 | 1014 | 1065 | 1080 | 1038 | 1061 | 1043 |
| Foaming Seq I (mL) | D892 | 0/0 | 0/0 | 0/0 | 0/0 | 0/0 | 0/0 | 0/0 |
| Foaming Seq I (mL) | D892 | 0/0 | 0/0 | 0/0 | 0/0 | 0/0 | 0/0 | 0/0 |
| Foaming Seq I (mL) | D892 | 0/0 | 0/0 | 0/0 | 0/0 | 0/0 | 0/0 | 0/0 |
| Emulsion at 54°C (to 3 ml) (min) | D1401 | 10 | 10 | 10 | 10 | 10 | 10 | 10 |
| | | | | | | | | |
| | | | | | | | | |

FIG. 5

PRODUCTION OF LUBRICANT BASE STOCKS WITH CONTROLLED AROMATIC CONTENTS

CROSS-REFERENCE TO RELATED APPLICATIONS

This application claims priority to U.S. Provisional Application Ser. No. 62/082,316 filed Nov. 20, 2014, which is herein incorporated by reference in its entirety.

FIELD

Systems and methods are provided for production of lubricant base stocks with controlled levels of aromatics content.

BACKGROUND

Dewaxing is a commonly used technique for improving the properties of a petroleum fraction for use in various products, such as lubricant base stocks. Typical dewaxing process feedstocks are raffinates from solvent extraction processes, wax vacuum gas stocks, hydrocrackates, and other wax-containing petroleum streams. Historically, solvent dewaxing was the first type of dewaxing used in the manufacture of lubricant base stocks. Solvent dewaxing, following a solvent extraction step, allowed for separation of a feedstock into a dewaxed base stock, an aromatics fraction, and a waxy fraction. More recently, catalytic dewaxing has been commonly used for improving the properties of feeds for use in lubricant base stocks.

Catalytic processing is commonly used for production of Group II and Group III type lubricant base stocks. During the various hydroprocessing and catalytic dewaxing steps involved in catalytic base stock production, a feedstock is usually exposed to multiple catalysts with at least some activity for saturating aromatic compounds. As a result, the catalytic processing steps used for improving the viscosity and other lubricant properties of Group II and/or Group III base stocks can also lead to reduction of the amount of aromatic compounds in the base stock.

U.S. Pat. No. 8,658,018 describes a lubricant base stock blend having a low wt % Noack volatility. The blends of lubricant base stocks include blends of light neutral base stocks having low aromatics content with Group I or Group II petroleum-derived base stocks. The blends are described as including at least 5 wt % of the Group I or Group II petroleum-derived base stock.

SUMMARY

In an aspect, a method for forming a lubricant base stock having at least a threshold aromatics content during the course of a processing run is provided. The method includes hydroprocessing a feedstock under first effective hydroprocessing conditions to form a hydroprocessed effluent; separating the hydroprocessed effluent to form at least a gas phase effluent and a liquid phase effluent; dewaxing at least a portion of the liquid phase effluent in the presence of a dewaxing catalyst under effective dewaxing conditions to form a dewaxed effluent; blending at least a portion of the dewaxed effluent with an aromatics-rich base stock to form an aromatics-enriched effluent, the aromatics-rich base stock comprising a Group I base stock, an alkylated aromatic base stock, or a combination thereof, the aromatics-enriched effluent containing about 0.25 wt % to about 1.25 wt % of the aromatics-rich base stock at a first time during the processing run; decreasing the amount of aromatics-rich base stock blended with the at least a portion of the dewaxed effluent at one or more times during the processing run subsequent to the first time; and fractionating at least a portion of the aromatics-enriched effluent to form at least a lubricant base stock product having a viscosity index of at least about 80 and a sulfur content of 300 wppm or less, wherein the lubricant base stock product at the first time during the processing run contains an amount of aromatics corresponding to at least an aromatics threshold amount, and wherein the lubricant base stock product at the one or more times during the processing run subsequent to the first time contains an amount of aromatics corresponding to at least the aromatics threshold amount. In some aspects, the alkylated aromatic base stock can comprise an alkylated naphthalene base stock, an alkylated benzene base stock, or a combination thereof.

BRIEF DESCRIPTION OF THE DRAWINGS

FIG. 2 shows properties of potential base stocks for use in blending to form a finished product with increased aromatics content.

FIG. 3 shows examples of results from the blending of base stocks to form a base stock with increased aromatics content.

FIG. 4 shows examples of lubricant performance in engine oil formulations with base stocks of increasing aromatics content.

FIG. 5 shows examples of lubricant performance in engine oil formulations with base stocks of increasing aromatics content.

DETAILED DESCRIPTION

Figure 1:
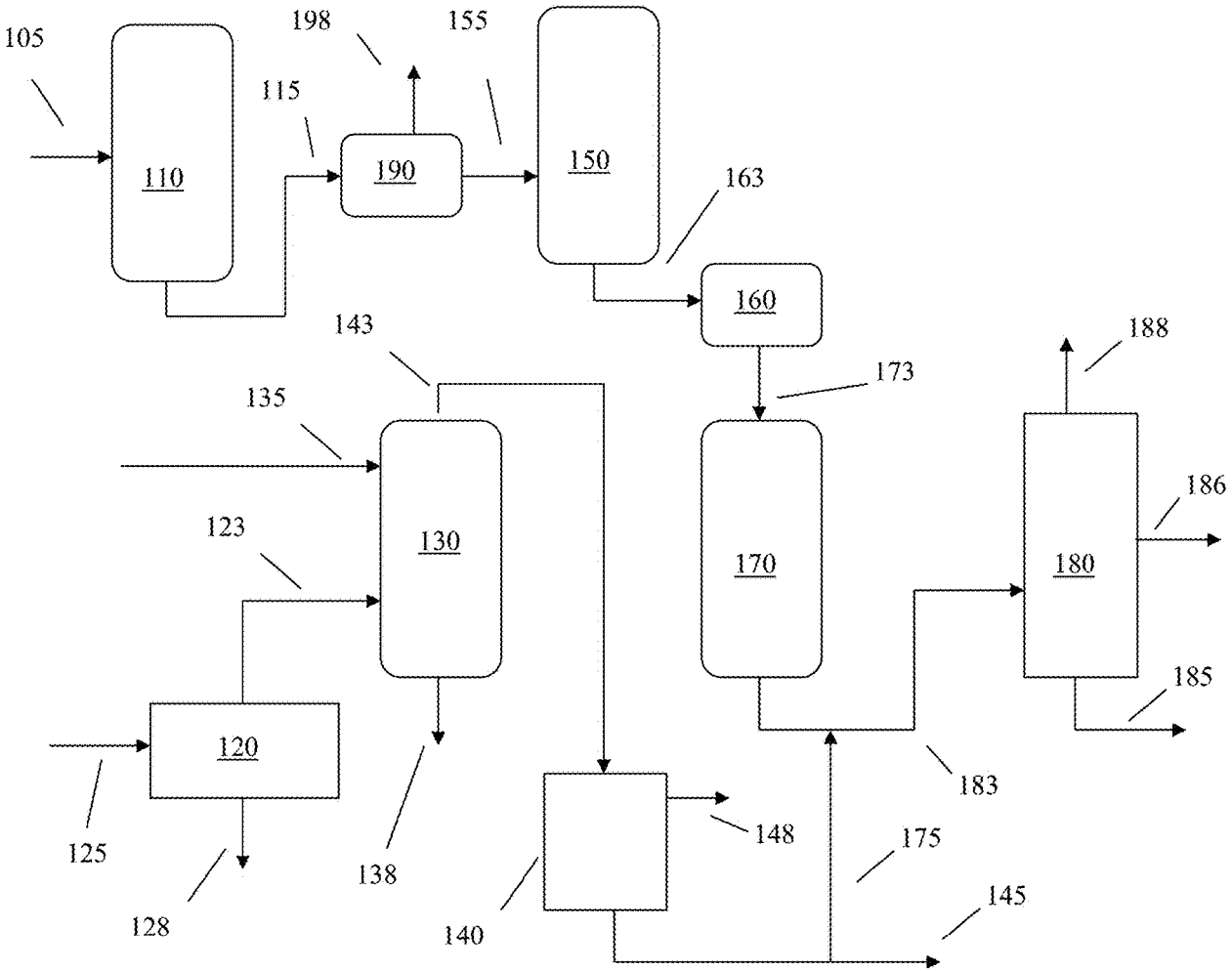
FIG. 1 schematically shows an example of a configuration suitable for processing a feedstock to form light and heavy base stock products.

All numerical values within the detailed description and the claims herein are modified by "about" or "approximately" the indicated value, and take into account experimental error and variations that would be expected by a person having ordinary skill in the art.

Overview

In various aspects, methods are provided for producing Group II and Group III base stocks with a controlled or consistent aromatics content. A base stock stream with high aromatics content can be added to the catalytically treated base stock in a minimal amount. For example, a small portion of a Group I base stock can be added to the catalytically processed feedstock. The Group I base stock can be added to the feed after the final catalytic treatment step but prior to fractionation. Typical Group I base stocks produced by solvent processing can have aromatics content on the order of about 10 wt % to about 40 wt %, which can be two or three orders of magnitude greater than the expected aromatics content of a catalytically processed Group II or Group III base stock. At the beginning of a processing run for forming lubricant base stock products, Group I base stock can be added to a catalytically processed feed after the final catalytic processing stage but prior to fractionation to form the Group II and/or Group III base stock. The amount of Group I base stock added to the catalytically processed feed can be, for example, about 0.25 wt % to about 1.25 wt % of the combined weight of the catalytically processed feed and the Group I base stock. During the course of the processing run, the amount of Group I base stock added can be reduced roughly in correspondence with the increase in aromatics caused by catalyst deactivation. This can allow a catalytically processed lubricant base stock product to be generated that contains at least about a minimum aromatics content during the course of a processing run. Alternatively, this can allow a catalytically processed lubricant base stock product to be generated that has consistent aromatics content during the course of the processing run.

It is noted that some Group V base stocks with a sufficiently high aromatics content could also be added to a catalytically processed feed in addition to or in place of addition of a Group I base stock. The "Group V" base stock category is a category for base stocks that do not fit within the definition of Groups I to IV. As a result, Group V base stocks can correspond to a wide variety of types of base stocks. An example of a Group V base stock that could be suitable for use in addition to or in place of a Group I base stock is an alkylated aromatic base stock, such as a base stock containing alkylated naphthalene(s) and/or alkylated benzene(s). For ease of understanding, aspects of the invention may described herein with reference to addition of a Group I base stock. However, unless otherwise specified, it is understood that an alkylated naphthalene and/or alkylated benzene and/or alkylated aromatic Group V base stock, or another Group V base stock with sufficiently high aromatics content, could also be suitable for use in addition to or in place of a Group I base stock. Suitable Group I base stocks and/or Group V base stocks can be generally referred to herein as aromatics-rich base stocks.

In this discussion, the aromatics content of a lubricant base stock can be described either prior to addition of a Group I base stock (or other aromatics-rich base stock) to increase aromatics content and after the addition of such a Group I base stock. It is noted that addition of a Group I base stock for increasing the aromatics content can typically be done prior to performing a final fractionation to separate the lubricant base stock from other portions of the effluent from the catalytic processing of a feed to form the base stock. As a result, it can be convenient to specify the aromatics content of a lubricant base stock fraction of the effluent from catalytic processing. For example, it can be convenient to specify the aromatics content of a dewaxing effluent, or the aromatics content of a dewaxed and hydrofinished effluent. To avoid ambiguity, the aromatics content of a lubricant base stock fraction, either prior to addition of a Group I base stock or after addition of a Group I base stock, is defined as the aromatics content for the lubricant base stock fraction after fractionation to separate the lubricant base stock from distillate fuel fractions and/or other fractions with different boiling ranges. This can allow for specification of the lubricant base stock fraction in an effluent prior to addition of a Group I base stock, even though the actual fractionation of the effluent may not occur until after the effluent has been enriched in aromatics by addition of the Group I base stock.

During catalytic production of lubricant base stocks, a substantial portion of the aromatic saturation performed during the catalytic processing occurs in one or more initial hydrotreatment stages. Optionally, some or all of the hydrotreatment stages can correspond to hydrocracking stages. Additional aromatic saturation can also be performed during dewaxing steps. Still more aromatic saturation can occur during hydrofinishing steps.

Although aromatic saturation can occur in hydrotreating, dewaxing, and hydrofinishing processes, the aromatics content of the effluent from these processes is typically not directly used to determine the reaction conditions. For example, for the hydrotreatment stage or stages, the reaction conditions are typically selected in order to achieve a desired increase in the viscosity index; to achieve a desired reduction of the amount of sulfur in the feed; and/or to achieve a desired reduction of the amount of nitrogen in the feed. For a dewaxing process, the reaction conditions are typically selected in order to achieve a desired pour point for the final base stock. For a hydrofinishing process, the reaction conditions are typically selected to achieve a desired level of polynuclear aromatics (PNAs) in the final base stock. During processing, the catalysts used for hydrotreating, dewaxing, and hydrofinishing tend to deactivate over time at varying rates. To compensate for this deactivation, the temperature for performing these processes can be increased to continue to achieve the desired targets. However, the activity for aromatic saturation typically does not deactivate at the same relative rate as other types of activity. As a result, even though other desired target properties are being maintained, the amount of aromatics saturation occurring in the reaction system may decrease, resulting in an increase over time in the amount of aromatics present in the final base stock.

As an example, a common difficulty with catalytic hydrotreatment of sulfur and nitrogen containing feeds is that the hydrotreatment catalysts tend to deactivate over time. In order to maintain a constant overall amount of reaction, the severity of the reaction conditions in a hydrotreatment reactor can be increased over time to compensate for the loss in catalyst activity. However, the reaction conditions in the hydrotreatment reactor(s) are usually selected to satisfy the requirements for desulfurization, denitrogenation, and/or viscosity index increase of a feed. As a result, as the hydrotreatment catalyst in the hydrotreatment stage(s) deactivates, the adjustments to the reaction conditions may not be sufficient to maintain a desired aromatics content in the hydrotreated effluent. Although the subsequent dewaxing and hydrofinishing stages may provide some additional aromatics saturation, an increased amount of aromatics in the hydrotreated effluent can tend to result in an increased amount of aromatics in the effluent from the dewaxing/hydrofinishing stages. This can cause the aromatic content of a resulting base stock at the start of a processing run to differ from the end of the run by an amount on the order of about 1 wt % to about 8 wt %. Although both the start of the run and the end of the run aromatics contents represent values within the typical specification for a Group II or Group III base stock, the difference in the aromatics contents can be sufficient to impact the overall formulation of a finished lubricant product.

The deactivation of catalysts over time can also lead to other difficulties. For example, as the temperature in the hydrotreatment stage is increased to compensate for deactivation, equilibrium reactions governing the formation of multi-ring aromatic compounds can be driven toward increased concentrations of such compounds in the effluent of the hydrotreatment stage. In addition to being an undesirable side product, the increased formation of the multi-ring aromatics in an upstream hydrotreatment stage also contributes to the overall tendency for increased aromatics in a the final base stock during the course of a processing run. Similar difficulties with increased formation of multi-ring aromatics may also be encountered in other catalytic processing steps.

In various aspects, instead of allowing the aromatics content of a final lubricant base stock product to change primarily due to catalyst deactivation during the course of a processing run, the aromatics content of the base stock can instead be controlled to reduce the variation in the aromatics content over time. One option can be to select a baseline or threshold level for the aromatics content, so that the aromatics content of the base stock corresponds to at least the threshold level throughout the processing run. In this type of option, during the initial portions of a processing run, the aromatics content of the base stock product prior to addition of Group I base stock (or a suitable Group V base stock) can be less than the threshold value. A Group I base stock can be added to the base stock product (i.e., to the catalytically processed effluent prior to fractionation) so that the resulting base stock product has an aromatics content greater than the threshold value. During the processing run, the amount of aromatics added to the catalytically processed effluent can be reduced as the catalyst(s) deactivate, so long as the amount of aromatics in the base stock product (after addition of the Group I base stock) remains above the threshold level. As the catalysts for processing the feed continue to deactivate, the amount of aromatics present in the catalytically processed base stock (prior to addition of Group I base stock) can eventually increase to an amount greater than the threshold level. When the amount of aromatics present in the base stock product without addition of Group I base stock is greater than the threshold level, the aromatics addition can be stopped entirely.

The threshold level of aromatics for the lubricant base stock can be set to any convenient amount. For example, the threshold level can be selected based on a percentage of the highest aromatics content for the final base stock product, prior to/without addition of Group I base stock, during the course of a processing run. Typically the highest aromatics content for the catalytically processed effluent prior to addition of Group I base stock will occur at the end of the processing run, but the highest aromatics content could occur at other points during a processing run if, for example, catalyst change-outs are performed on portions of the catalyst in a reaction system. In such an aspect, the threshold level for the aromatics content can be at least about 10% of the highest aromatics content for the base stock product, prior to/without addition of Group I base stock, during the course of a processing run, or at least about 20% of the highest aromatics content, or at least about 30%, or at least about 40%, or at least about 50%, or at least about 70%, or at least about 90%. In this type of aspect, the threshold level for the aromatics content can be about 100% or less of the highest aromatics content for the base stock product prior to addition of the Group I base stock, or about 90% or less, or about 70% or less, or about 50% or less. Mathematically, this method for setting the threshold level of aromatics for a base stock product can be expressed as $T=x*A_{max}$, where T is the threshold level, $A_{max}$ is the highest aromatics content during the course of a processing run for the base stock product prior to addition of any Group I (or Group V) base stock, and x is a value between 0 and 1 that corresponds to the fraction (percentage) of $A_{max}$ that is used to set the threshold value T.

As an alternative, after selecting the threshold level of aromatics, a constant amount of aromatics can be added to the base stock until the aromatics content of the base stock product (prior to addition of Group I base stock) is greater than the threshold level. In this alternative, instead of decreasing the added amount of aromatics over time, the amount of added aromatics can be constant until the aromatics addition is stopped. This can reduce the amount of monitoring of the aromatics content that is needed, as the amount of aromatics added to the base stock is only changed at one time (or possibly at a few times) during the course of the processing run. Of course, other schedules for how frequently to adjust the amount of added aromatics can be developed in order to provide a final base stock containing at least a threshold amount of aromatics. The threshold level T in this type of aspect can be selected, for example, in the same manner as described above.

Still another option can be to control the aromatics content so that the aromatics content of the base stock product after addition of any Group I base stock remains relatively constant over time. In order to achieve this goal, a desired aromatics content or threshold can be selected for the lubricant base stock after any addition of Group I base stock, where the threshold is comparable to or greater than the aromatics content of the lubricant base stock product, prior to addition of Group I base stock, at the end of the processing run (or at the time during the processing run having the highest aromatics content.) In this type of option, aromatics addition may continue throughout most or even all of the processing run in order to maintain the substantially constant amount of aromatics in the base stock product after inclusion of any Group I base stock. In this type of aspect, the threshold level for the aromatics content can be at least about 70% of the highest aromatics content, prior to addition of a Group I base stock, during the course of a processing run, or at least about 80% of the highest aromatics content, or at least about 90%, or at least about 100%, or at least about 105%. Additionally or alternately, the threshold level for the aromatics content can be about 150% or less of the highest aromatics content, prior to addition of Group I base stock, during the course of a processing run, or about 125% or less, or about 105% or less, or about 100% or less, or about 95% or less, or about 85% or less. In this type of aspect, when the threshold level is selected to be less than the highest aromatics content during the course of the processing run, the addition of aromatics to the final base stock can be stopped when a sufficient aromatics content is detected in the base stock product prior to aromatics addition. When the threshold level is selected to be comparable to or greater than the highest aromatics content prior to addition of the Group I base stock, the Group I base stock can be added throughout the entire processing run in order to maintain the threshold level of aromatics. Mathematically, this method for setting the threshold level of aromatics for a base stock product can be expressed as $T=x*A_{max}$, where T is the threshold level, $A_{max}$ is the highest aromatics content during the course of a processing run for the base stock product prior to addition of any Group I (or Group V) base stock, and x is a value between 0.7 and 1.5.

The aromatics content in the desired lubricant base stock can be determined by any convenient method. Commonly used methods include ASTM D2007, ASTM D7419, and IP 368. One option for determining the aromatics content of the lubricant base stock product can be to determine the aromatics content according to ASTM D2008, such as the current standard D2008-12. ASTM D2008 provides one example of a method for correlating data generated from UV/VIS spectroscopy with a weight of aromatics present in a sample. Alternatively, other methods for correlating data from UV/VIS spectroscopy with a weight of aromatics in a sample can also be used.

More generally, a variety of correlations can potentially be used to correlate spectroscopic data, such as ultraviolet/visible (UV/VIS) spectroscopic data, with an aromatics content of a sample. Even though the aromatics content of a catalytically processed lubricant base stock is generally quite low, consistently providing a substantial similar absolute amount can be valuable. A consistent aromatics level can be beneficial to formulated lubricant product development, as well as having potential marketing benefits as customers can expect a substantially constant quality, even at the start of a catalyst cycle. Thus, independent of the method of measuring the aromatics content, a desirable goal can be to produce a lubricant base stock that has a substantially consistent aromatics content during the early stages of a processing run, during the entire course of a processing run, or during any other convenient portion of a processing run.

Another example of a suitable method for characterizing the weight of aromatics in a final base stock sample is to use a correlation between the weight of aromatics in a sample and the adsorbence at a particular wavelength in the UV spectrum. For example, UV absorbance at 226 nm has previously been used to characterize the weight of total aromatics in a base stock product, and use of UV absorbance at 226 nm for characterizing the weight of aromatics is broadly known to those skilled in the art. U.S. Pat. No. 6,569,312 provides an example of the use of UV absorbance at 226 nm for characterization of total aromatics content in a product.

It is noted that UV/VIS spectroscopy provides a convenient method for characterization of aromatics content on a relatively short time scale. For example, during the course of a processing run, the lubricant base stock product can be sampled on a periodic basis, such as once a day, and then characterized to determine the aromatics content. The determined aromatics content can then be used to adjust the amount of Group I base stock added to the feed prior to fractionation. Other characterization methods for determining the aromatics content may also be used if such methods are convenient for periodic characterization. For example, characterization by other spectroscopic methods or by various types of gas chromatography methods could be used if desired.

In this discussion, the beginning of a processing run can be defined in various ways. In some aspects, the beginning of a processing run can correspond to the point in a processing run where recovery of the catalytically processed effluent is started for addition to the product pool for the desired base stock product. For example, during a catalyst break-in period for some types of catalysts, it might be desirable to exclude the effluent generated during catalyst break-in from the product pool. In such an aspect, the beginning of a processing run could correspond to the end of the catalyst break-in period, or the end of some other initial conditioning period for allowing one or more parts of a reaction system to reach a desired state. Alternatively, the beginning of a processing run could correspond to the initial introduction of the desired feedstock for forming the lubricant base stock product. It is noted that a processing run does not need to be continuous. After the beginning of a processing run, for example, processing could be stopped and restarted for various reasons, such as change-out of dewaxing or hydrofinishing catalysts or routine maintenance. While such stoppages in processing could cause a temporary fluctuation in the aromatics level, if the overall trend toward higher aromatics content is continued after re-start, the processing run can still be considered as continuing. In some aspects, the end of a processing run can be defined as an event that allows the aromatics content of the base stock product, prior to addition of Group I base stock, to be returned to a lower aromatics content that is substantially similar to the beginning of the run. Alternatively, the end of a processing run can correspond to any change in the feedstock, reaction system, and/or reaction conditions so that further products generated by the reaction system are not combined with the previous products generated by the reaction system. In still other aspects, any other conventional method for defining the beginning of a processing run for forming a lubricant base stock product can be used.

As a particular example, the hydrotreating catalyst(s) and/or hydrocracking catalysts in a reaction system typically perform the largest amount of aromatic saturation in the reaction system. In some reaction systems, the difference between the minimum and maximum aromatics content in the catalytically processed effluent from a reaction system can roughly correspond to the difference between use of a fresh hydrotreating/hydrocracking catalyst and use of a catalyst near the end of the catalyst lifetime. In such an aspect, the beginning of a processing run can be defined based on when accumulation of base stock product is started after change out of hydrotreating and/or hydrocracking catalyst in a reaction system. This accumulation may optionally start after a period of catalyst break-in for the hydrotreating/hydrocracking catalyst. In this type of aspect, the end of the processing run can correspond to the next time the hydrotreating and/or hydrocracking catalyst is changed. Alternatively, the end of the processing run could correspond to a change in the feedstock so that a different product slate is generated by the reaction system.

At the beginning of the run, about 0.25 wt % to about 1.25 wt % of a Group I base stock (based on total weight after addition) can then be added to the catalytically processed effluent prior to fractionation. For example, about 0.25 wt % to about 1.0 wt % of a Group I base stock can be added prior to fractionation, or about 0.25 wt % to about 0.75 wt %, or about 0.5 wt % to about 1.25 wt %, or about 0.5 wt % to about 1.0 wt %, or about 0.75 wt % to about 1.25 wt %. The amount of Group I base stock added can be based on the amount of Group I base stock that is necessary to achieve the selected target (threshold) aromatics content at the beginning of the run. In some aspects, the amount of added Group I base stock can then be reduced over time, as the catalysts age and the increase in the temperature of one or more of the processing stages results in a corresponding increase in the aromatics content of the catalytically processed portion of the base stock prior to addition of the Group I base stock. The aromatics content of the base stock either prior to or after addition of the Group I base stock can be determined, for example, by UV absorbtivity at 226 nm. If the threshold value for the aromatics content is less than the highest aromatics content (prior to addition of Group I base stock) during the processing run, the addition of aromatics can be stopped prior to the end of the processing run while still maintaining the threshold level. Due to the low quantities of the additional Group I base stock required to achieve the desired aromatics content, the other properties of the resulting Group II and/or Group III base stock product after fractionation can have substantially similar values to the base stock properties without the addition of the Group I base stock. Similarly, if another aromatics-rich base stock (such as an alkylated naphthalene or alkylated benzene base stock) is added to achieve the desired aromatics content, the other properties of the resulting Group II and/or Group III base stock product after fractionation can have substantially similar values to the base stock properties without the addition of the aromatics-rich base stock.

Alternatively, if the threshold level is greater than the highest aromatics content for the base stock (prior to addition of the Group I base stock), the addition of the Group I base stock can continue throughout the processing run. In such an alternative aspect, at a the end of the processing run, the amount of Group I base stock blended with effluent prior to fractionation can be about 0.5 wt % or less (based on total weight of effluent after addition), or about 0.25 wt % or less or about 0.15 wt % or less, or about 0.1 wt % or less.

It is possible that the Group I base stock could be added at least partially after fractionation instead of prior to fractionation. However, addition of the Group I base stock after fractionation would mean that compounds outside of the typical boiling range for the desired Group II or Group III base stock may be present in the final base stock product. This could lead to an increased impact on the properties of the final Group II or Group III base stock product. Addition of a portion of the Group I base stock prior to the final aromatic saturation stage would be less desirable, as this would result in additional hydrogen consumption to saturate the additional aromatics provided in the Group I base stock while having little or no impact on the final aromatics content. Also, the heteroatom contaminants present in Group I base stocks, such as sulfur, can potentially reduce or minimize the activity and/or selectivity of the dewaxing or hydrofinishing catalysts typically used in the second process stage.

Addition of a Group I base stock to the process train for forming a Group II and/or Group III base stock represents an addition of material that is at least partially in the desired boiling range for the product base stock. Such Group II and/or Group III base stocks are often higher value products, so the net impact of addition of the Group I base stock can often be to generate an increased yield for a higher value product, with the properties of the product being substantially similar to the properties when no Group I base stock is added. Examples of product properties that can be substantially similar before and after addition of a Group I base stock (and/or an alkylated naphthalene and/or an alkylated benzene and/or other suitable aromatics-rich base stock) can include, but are not limited to, pour point; Scanning Brookfield gel index; mini-rotary viscometer (MRV) viscosity, oxidative stability, cold cranking simulator (CCS) viscosity, Saybolt color, kinematic viscosity at 100° C., other kinematic or dynamic viscosity measures, and viscosity index. This is in contrast to conventional solutions for attempting to maintain a desired aromatics content in a Group II or Group III base stock, where maintaining the desired aromatics content can lead to other difficulties.

As an example of a conventional solution, one option for maintaining a desired level of aromatics in a base stock produced using catalytic processing can be to retain a constant temperature for the hydrotreatment stage and instead decrease the space velocity of the feed as it passes through the hydrotreatment stage. Reducing the space velocity allows a feed to be exposed to a catalyst for a greater amount of time, which can allow a desired level of reaction to be maintained as a catalyst deactivates. The reduced space velocity also does not impact the equilibria for formation of multi-ring aromatics, so that additional formation of aromatics can also be reduced or minimized. However, reducing the space velocity directly results in a reduction of the amount of feed that is processed within a reactor. Thus, the total amount of lubricant base stock that can be generated by a reaction system will decrease over time if changes to the space velocity are used in place of increasing the temperature of a reactor.

A similar type of alternative to reducing the space velocity can be to increase the hydrogen partial pressure. In some aspects, this can correspond to increasing the hydrogen purity of the makeup gas, the recycle gas, or both. This provides another method for increasing reactivity in the reactor without increasing temperature. However, hydrogen is usually a limited resource within a refinery setting, and opportunities for additional purification of hydrogen gas streams can be limited. As a result, increasing the amount of available hydrogen for producing lubricant base stocks can also reduce the amount of hydrogen available for other processes within the refinery.

Still another option can be to reduce the outlet temperature for one or more final catalyst beds of the hydrotreating stage and/or of the dewaxing and hydrofinishing stage. Increasing the temperature in the hydrotreating stage or in the dewaxing and hydrofinishing stage can lead to increased formation of multi-ring aromatics due to various equilibrium reactions. One way to reduce or minimize the formation of the multi-ring aromatics is to use multiple beds within a reaction stage. The earlier beds in a stage (such as the earlier hydrotreating catalyst beds or the dewaxing catalyst beds) can be operated at a higher temperature in order to achieve desired product specifications, such as a target sulfur level, a desired amount of viscosity index uplift, or a desired pour point. One or more final beds can then be operated at a lower temperature. The lower temperature beds can drive the equilibrium reactions toward lower formation of multi-ring aromatics.

Yet another option can be to restrict the slate of feedstocks used for production of lubricant base stocks, so that feedstocks with initially reduced levels of aromatics are selected. If the feedstock starts with a reduced level of aromatics, the amount of aromatic saturation in the hydrotreating stages can be less important.

According to API's classification, Group I base stocks are defined as base stocks with less than 90 wt % saturated molecules and/or at least 0.03 wt % sulfur content. Group I base stocks also have a viscosity index (VI) of at least 80 but less than 120. Group II base stocks contain at least 90 wt % saturated molecules and less than 0.03 wt % sulfur. Group II base stocks also have a viscosity index of at least 80 but less than 120. Group III base stocks contain at least 90 wt % saturated molecules and less than 0.03 wt % sulfur, with a viscosity index of at least 120.

In this discussion, a stage can correspond to a single reactor or a plurality of reactors. Optionally, multiple parallel reactors can be used to perform one or more of the processes, or multiple parallel reactors can be used for all processes in a stage. Each stage and/or reactor can include one or more catalyst beds containing hydroprocessing catalyst.

In this discussion, unless otherwise specified the lubricant product fraction of a catalytically processed feedstock corresponds to the fraction having an initial boiling point or alternatively a T5 boiling point of at least about 370° C. (700° F.). A distillate fuel product fraction, such as a diesel product fraction, corresponds to a product fraction having a boiling range from about 193° C. (375° F.) to about 370° C. (700° F.). Thus, distillate fuel product fractions have initial boiling points (or alternatively T5 boiling points) of at least about 193° C. and final boiling points (or alternatively T95 boiling points) of about 370° C. or less. A naphtha fuel product fraction corresponds to a product fraction having a boiling range from about 50° C. (122° F.) to about 193° C. (375° F.) to about 370° C. (700° F.). Thus, naphtha fuel product fractions have initial boiling points (or alternatively T5 boiling points) of at least about 50° C. and final boiling points (or alternatively T95 boiling points) of about 193° C. or less. It is noted that 50° C. roughly corresponds to a boiling point for the various isomers of a C6 alkane. When determining a boiling point or a boiling range for a feed or product fraction, an appropriate ASTM test method can be used, such as the procedures described in ASTM D2887 or D86.

Feedstocks

A wide range of petroleum and chemical feedstocks can be hydroprocessed in accordance with the invention. Suitable feedstocks include whole and reduced petroleum crudes, atmospheric residua, propane deasphalted residua, cycle oils, gas oils, including vacuum gas oils and coker gas oils, light to heavy distillates including raw virgin distillates, hydrocrackates, hydrotreated oils, slack waxes, Fischer-Tropsch waxes, raffinates, and mixtures of these materials. Optionally, feeds derived from a biological source that have an appropriate boiling range can also form at least a portion of the feedstock.

One way of defining a feedstock is based on the boiling range of the feed. One option for defining a boiling range is to use an initial boiling point for a feed and/or a final boiling point for a feed. Another option, which in some instances may provide a more representative description of a feed, is to characterize a feed based on the amount of the feed that boils at one or more temperatures. For example, a "T5" boiling point for a feed is defined as the temperature at which 5 wt % of the feed will boil off. Similarly, a "T95" boiling point is a temperature at 95 wt % of the feed will boil.

Typical feeds include, for example, feeds with an initial boiling point of at least about 650° F. (343° C.), or at least about 700° F. (371° C.), or at least about 750° F. (399° C.). Alternatively, a feed may be characterized using a T5 boiling point, such as a feed with a T5 boiling point of at least about 650° F. (343° C.), or at least about 700° F. (371° C.), or at least about 750° F. (399° C.). In some aspects, the final boiling point of the feed can be at least about 1100° F. (593° C.), such as at least about 1150° F. (621° C.) or at least about 1200° F. (649° C.). In other aspects, a feed may be used that does not include a large portion of molecules that would traditional be considered as vacuum distillation bottoms. For example, the feed may correspond to a vacuum gas oil feed that has already been separated from a traditional vacuum bottoms portion. Such feeds include, for example, feeds with a final boiling point of about 1100° F. (593° C.), or about 1000° F. (538° C.) or less, or about 900° F. (482° C.) or less. Alternatively, a feed may be characterized using a T95 boiling point, such as a feed with a T95 boiling point of about 1100° F. (593° C.) or less, or about 1000° F. (538° C.) or less, or about 900° F. (482° C.) or less. An example of a suitable type of feedstock is a wide cut vacuum gas oil (VGO) feed, with a T5 boiling point of at least about 700° F. (371° C.) and a T95 boiling point of about 1100° F. or less. Optionally, the initial boiling point of such a wide cut VGO feed can be at least about 700° F. and/or the final boiling point can be at least about 1100° F. It is noted that feeds with still lower initial boiling points and/or T5 boiling points may also be suitable, so long as sufficient higher boiling material is available so that the overall nature of the process is suitable for production of lubricant base stocks.

The above feed description corresponds to a potential feed for producing lubricant base stocks. In some aspects, lubricant base stocks can be produced as part of a process for producing both fuels and lubricants. Because fuels are a desired product in such processes, feedstocks with lower boiling components may also be suitable. For example, a feedstock suitable for fuels production, such as a light cycle oil, can have a T5 boiling point of at least about 350° F. (177° C.), such as at least about 400° F. (204° C.). Examples of a suitable boiling range include a boiling range of from about 350° F. (177° C.) to about 700° F. (371° C.), such as from about 390° F. (200° C.) to about 650° F. (343° C.). Thus, a portion of the feed used for fuels and lubricant base stock production can include components having a boiling range from about 170° C. to about 350° C. Such components can be part of an initial feed, or a first feed with a T5 boiling point of about 650° F. (343° C.) can be combined with a second feed, such as a light cycle oil, that includes components that boil between 200° C. and 350° C.

In embodiments involving an initial sulfur removal stage prior to hydrocracking, the sulfur content of the feed can be at least 300 ppm by weight of sulfur, or at least 1000 wppm, or at least 2000 wppm, or at least 4000 wppm, or at least 10,000 wppm, or at least about 20,000 wppm. In other embodiments, including some embodiments where a previously hydrotreated and/or hydrocracked feed is used, the sulfur content can be about 2000 wppm or less, or about 1000 wppm or less, or about 500 wppm or less, or about 100 wppm or less.

Catalytic Processing for Production of Lubricant Base Stocks

In various aspects, a suitable feedstock can be processed under catalytic processing conditions to form API Group II or Group III base stocks.

In the discussion herein, reference will be made to a reaction system for catalytic processing of a feed. The reaction system corresponds to a plurality of stages, such as two stages and/or reactors and optional intermediate separator(s), that are used to expose a feed to a plurality of catalysts under hydroprocessing (hydrotreating and/or hydrorcracking), dewaxing, and/or hydrofinishing conditions. The plurality of catalysts can be distributed between the stages and/or reactors in any convenient manner, with some preferred methods of arranging the catalyst described herein.

Various types of catalytic processing can be used in the production of lubricant base stocks, including production of lubricant base stocks as one of several products generated during a fuels hydrocracking process. Typical processes include a hydrotreating and/or hydrocracking process to provide uplift in the viscosity index (VI) of the feed. The hydrotreated feed can then be dewaxed to improve cold flow properties, such as pour point or cloud point. The hydrotreated (and/or hydrocracked), dewaxed feed can then be hydrofinished, for example, to remove additional aromatics from the lubricant base stock product. This can be valuable for removing compounds that are considered oxidatively unstable or hazardous under various regulations. In addition to the above, the initial hydrotreatment and/or hydrocracking stage(s) can also be used for contaminant removal.

In some aspects, an initial step can be to hydrotreat and/or hydrocrack a feedstock. Examples of suitable configurations can include reactors suitable for performing hydrotreatment and/or for performing lubes hydrocracking or fuels hydrocracking. This can correspond to a two stage hydrotreater, a two stage hydrocracker, or a first hydrotreater stage and a second hydrocracker stage. In still other aspects, the hydrocracking may be performed in a single stage and/or reactor, or more than two stages may be used, or any other convenient combination of hydrotreating and/or hydrocracking stages may be used. When multiple stages are present, a separator (or separators) can be used between the various stages, such as high temperature separators, to allow for removal of $H_2$, $NH_3$, and/or other contaminant gases and light ends in between the stages of the reaction system.

Hydrotreatment Conditions

In some aspects, at least a portion of the catalyst in the initial stage(s) of the reaction system for catalytic processing can correspond to hydrotreatment catalyst. For example, one or more beds of catalyst in the first stage of a multi-stage reaction system can be hydrotreating catalyst. Optionally, the first stage can correspond to a hydrotreatment stage, with hydrocracking being performed in the second stage.

Hydrotreatment is typically used to reduce the sulfur, nitrogen, and aromatic content of a feed. The catalysts used for hydrotreatment of the heavy portion of the crude oil from the flash separator can include conventional hydroprocessing catalysts, such as those that comprise at least one Group VIII non-noble metal (Columns 8-10 of IUPAC periodic table), preferably Fe, Co, and/or Ni, such as Co and/or Ni; and at least one Group VI metal (Column 6 of IUPAC periodic table), preferably Mo and/or W.

The catalysts can either be in bulk form or in supported form. An example of a supported catalyst can be a catalyst including one or more transition metal sulfides that are impregnated or dispersed on a refractory support or carrier such as alumina and/or silica. In addition to alumina and/or silica, other suitable support/carrier materials can include, but are not limited to, zeolites, titania, silica-titania, and titania-alumina. Suitable aluminas are porous aluminas such as gamma or eta having average pore sizes from 50 to 200 Å, or 75 to 150 Å; a surface area from 100 to 300 $m^2/g$, or 150 to 250 $m^2/g$; and a pore volume of from 0.25 to 1.0 $cm^3/g$, or 0.35 to 0.8 $cm^3/g$. More generally, any convenient size, shape, and/or pore size distribution for a catalyst suitable for hydrotreatment of a distillate (including lubricant base stock) boiling range feed in a conventional manner may be used. It is within the scope of the present invention that more than one type of hydroprocessing catalyst can be used in one or multiple reaction vessels.

In various aspects, a hydrotreating catalyst can contain at least one Group VIII non-noble metal, in oxide form, and can typically be present in an amount ranging from about 2 wt % to about 40 wt %, preferably from about 4 wt % to about 15 wt %. The at least one Group VI metal, in oxide form, can typically be present in an amount ranging from about 2 wt % to about 70 wt %, preferably for supported catalysts from about 6 wt % to about 40 wt % or from about 10 wt % to about 30 wt %. These concentrations are based on the total weight of the catalyst. Suitable metal catalysts include cobalt/molybdenum (1-10% Co as oxide, 10-40% Mo as oxide), nickel/molybdenum (1-10% Ni as oxide, 10-40% Co as oxide), or nickel/tungsten (1-10% Ni as oxide, 10-40% W as oxide) on alumina, silica, silica-alumina, or titania.

The hydrotreatment is carried out in the presence of hydrogen. A hydrogen-containing stream (a treat gas) is, therefore, fed or injected into a vessel or reaction zone or hydroprocessing zone in which the hydroprocessing catalyst is located. Treat gas, as referred to in this invention, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane), and which will not adversely interfere with or affect either the reactions or the products. The treat gas stream introduced into a reaction stage will preferably contain at least about 50 vol. % and more preferably at least about 75 vol. % hydrogen.

Treat gas can be supplied at a rate of from about 200 SCF/B (standard cubic feet of gas per barrel of feed) (35 $Nm^3/m^3$) to about 5000 SCF/B (891 $Nm^3/m^3$). Preferably, the treat gas is provided in a range of from about 1000 SCF/B (178 $Nm^3/m^3$) to about 3000 SCF/B (534 $Nm^3/m^3$). Treat gas can be supplied co-currently with the input feed to the hydrotreatment reactor and/or reaction zone or separately via a separate gas conduit to the hydrotreatment zone.

Hydrotreating conditions can include temperatures of 200° C. to 450° C., or 315° C. to 425° C.; pressures of 250 psig (1.8 MPag) to 5000 psig (34.6 MPag) or 300 psig (2.1 MPag) to 3000 psig (20.8 MPag); liquid hourly space velocities (LHSV) of 0.1 $hr^{-1}$ to 10 $hr^{-1}$; and treat gas rates of 200 scf/B (35 $Nm^3/m^3$) to 10,000 scf/B (1781 $Nm^3/m^3$), or 500 (89 $Nm^3/m^3$) to 10,000 scf/B (1781 $Nm^3/m^3$). The severity of the hydrotreating conditions can be selected to provide a desired amount of desulfurization, a desired amount of denitrogenation, a desired amount of viscosity index uplift, or a combination thereof.

Hydrocracking Conditions

In some aspects, one or more initial hydrotreatment steps can be sufficient to provide a desired amount of desulfurization, denitrogenation, and viscosity index uplift for formation of a desired lubricant base stock product. In other aspects, higher severity conditions (such as hydrocracking conditions) may be needed to generate additional conversion of a feed relative to a conversion temperature. Conversion of the feed can be defined in terms of conversion of molecules that boil above a temperature threshold to molecules below that threshold. The conversion temperature can be any convenient temperature, such as about 700° F. (371° C.). The amount of conversion can correspond to the total conversion of molecules within any stage of the reaction system that is used to hydroprocess the feedstock for lubricant base stock production. Suitable amounts of conversion of molecules boiling above 700° F. to molecules boiling below 700° F. include converting at least about 20% of the 700° F.+ portion of the feedstock to the stage(s) of the reaction system, or at least about 30% of the 700° F.+ portion, or at least about 40%, or at least about 50%, or at least about 60%. Additionally or alternately, the amount of conversion for the reaction system can be about 80% or less, or about 70% or less, or about 60% or less. Still larger amounts of conversion may also produce a suitable hydrocracker bottoms for forming lubricant base stocks, but such higher conversion amounts will also result in a reduced yield of lubricant base stocks. Reducing the amount of conversion can increase the yield of lubricant base stocks, but reducing the amount of conversion to below the ranges noted above may result in hydrocracker bottoms that are not suitable for formation of Group II or Group III lubricant base stocks.

In order to achieve a desired level of conversion, the catalytic process train can include at least one hydrocracking catalyst. Hydrocracking catalysts typically contain sulfided base metals on acidic supports, such as amorphous silica alumina, zeolites such as ultra-stable Y (USY), or acidified alumina. Often these acidic supports are mixed or bound with other metal oxides such as alumina, titania or silica. Examples of suitable acidic supports include acidic molecular sieves, such as zeolites or silicoaluminophophates. One example of suitable zeolite is USY, such as a USY zeolite with cell size of 24.25 Angstroms or less. Additionally or alternately, the catalyst can be a low acidity molecular sieve, such as a USY zeolite with a Si to Al ratio of at least about 20, and preferably at least about 40 or 50. Zeolite Beta is another example of a potentially suitable hydrocracking catalyst. Non-limiting examples of metals for hydrocracking catalysts include metals or combinations of metals that include at least one Group VIII metal, such as nickel, nickel-cobalt-molybdenum, cobalt-molybdenum, nickel-tungsten, nickel-molybdenum, and/or nickel-molybdenum-tungsten. Additionally or alternately, hydrocracking catalysts with noble metals can also be used. Non-limiting examples of noble metal catalysts include those based on platinum and/or palladium. Support materials which may be used for both the noble and non-noble metal catalysts can comprise a refractory oxide material such as alumina, silica, alumina-silica, kieselguhr, diatomaceous earth, magnesia, zirconia, or combinations thereof, with alumina, silica, alumina-silica being the most common (and preferred, in one embodiment).

In various aspects, the conditions selected for hydrocracking can depend on the desired level of conversion, the level of contaminants in the input feed to the hydrocracking stage, the number of stages, and potentially other factors. For example, in a configuration involving two hydrocracking stages, the hydrocracking conditions in the first stage and/or the second stage can be selected to achieve a desired level of conversion in the reaction system. A hydrocracking process in the first stage (or otherwise under sour conditions) can be carried out at temperatures of about 550° F. (288° C.) to about 840° F. (449° C.), hydrogen partial pressures of from about 250 psig to about 5000 psig (1.8 MPag to 34.6 MPag), liquid hourly space velocities of from 0.05 $h^{-1}$ to 10 $h^{-1}$, and treat gas rates of from 35 $Nm^3/m^3$ to 1781 $Nm^3/m^3$ (200 SCF/B to 10,000 SCF/B). In other embodiments, the conditions can include temperatures in the range of about 600° F. (343° C.) to about 815° F. (435° C.), hydrogen partial pressures of from about 500 psig to about 3000 psig (3.5 MPag-20.9 MPag), and hydrogen treat gas rates of from about 213 $m^3/m^3$ to about 1068 $m^3/m^3$ (1200 SCF/B to 6000 SCF/B). The LHSV relative to only the hydrocracking catalyst can be from about 0.25 $h^{-1}$ to about 50 $h^{-1}$, such as from about 0.5 $h^{-1}$ to about 20 $h^{-1}$, and preferably from about 0.5 $h^{-1}$ to about 4.0 $h^{-1}$ In some aspects, a portion of the hydrocracking catalyst can be contained in a second reaction stage. In such aspects, a first reaction stage of the hydroprocessing reaction system can include one or more hydrotreating and/or hydrocracking catalysts. The conditions in the first reaction stage can be suitable for reducing the sulfur and/or nitrogen content of the feedstock. A separator can then be used in between the first and second stages of the reaction system to remove gas phase sulfur and nitrogen contaminants. One option for the separator is to simply perform a gas-liquid separation to remove contaminants. Another option is to use a separator such as a flash separator that can perform a separation at a higher temperature. Such a high temperature separator can be used, for example, to separate the feed into a portion boiling below a temperature cut point, such as about 350° F. (177° C.) or about 400° F. (204° C.), and a portion boiling above the temperature cut point. In this type of separation, the naphtha boiling range portion of the effluent from the first reaction stage can also be removed, thus reducing the volume of effluent that is processed in the second or other subsequent stages. Of course, any low boiling contaminants in the effluent from the first stage would also be separated into the portion boiling below the temperature cut point. If sufficient contaminant removal is performed in the first stage, the second stage can be operated as a "sweet" or low contaminant stage.

Still another option can be to use a separator between the first and second stages of the hydroprocessing reaction system that can also perform at least a partial fractionation of the effluent from the first stage. In this type of aspect, the effluent from the first hydroprocessing stage can be separated into at least a portion boiling below the distillate (such as diesel) fuel range, a portion boiling in the distillate fuel range, and a portion boiling above the distillate fuel range. The distillate fuel range can be defined based on a conventional diesel boiling range, such as having a lower end cut point temperature of at least about 350° F. (177° C.) or at least about 400° F. (204° C.) to having an upper end cut point temperature of about 700° F. (371° C.) or less or 650° F. (343° C.) or less. Optionally, the distillate fuel range can be extended to include additional kerosene, such as by selecting a lower end cut point temperature of at least about 300° F. (149° C.).

In aspects where the inter-stage separator is also used to produce a distillate fuel fraction, the portion boiling below the distillate fuel fraction includes, naphtha boiling range molecules, light ends, and contaminants such as $H_2S$. These different products can be separated from each other in any convenient manner. Similarly, one or more distillate fuel fractions can be formed, if desired, from the distillate boiling range fraction. The portion boiling above the distillate fuel range represents the potential lubricant base stocks. In such aspects, the portion boiling above the distillate fuel range can be subjected to further hydroprocessing in a second hydroprocessing stage.

A hydrocracking process in a second stage (or otherwise under non-sour conditions, such as after a hydrotreating stage) can be performed under conditions similar to those used for a first stage hydrocracking process, or the conditions can be different. In an embodiment, the conditions in a second stage can have less severe conditions than a hydrocracking process in a first (sour) stage. The temperature in the hydrocracking process can be about 40° F. (22° C.) less than the temperature for a hydrocracking process in the first stage, or about 80° F. (44° C.) less, or about 120° F. (66° C.) less. The pressure for a hydrocracking process in a second stage can be 100 psig (690 kPa) less than a hydrocracking process in the first stage, or 200 psig (1380 kPa) less, or 300 psig (2070 kPa) less. Additionally or alternately, suitable hydrocracking conditions for a second (non-sour) stage can include, but are not limited to, conditions similar to a first or sour stage. Suitable hydrocracking conditions can include temperatures of about 550° F. (288° C.) to about 840° F. (449° C.), hydrogen partial pressures of from about 250 psig to about 5000 psig (1.8 MPag to 34.6 MPag), liquid hourly space velocities of from 0.05 $h^{-1}$ to 10 $h^{-1}$, and hydrogen treat gas rates of from 35 $Nm^3/m^3$ to 1781 $Nm^3/m^3$ (200 SCF/B to 10,000 SCF/B). In other embodiments, the conditions can include temperatures in the range of about 600° F. (343° C.) to about 815° F. (435° C.), hydrogen partial pressures of from about 500 psig to about 3000 psig (3.5 MPag-20.9 MPag), and treat gas rates of from about 213 $Nm^3/m^3$ to about 1068 $Nm^3/m^3$ (1200 SCF/B to 6000 SCF/B).

In still another embodiment, the same conditions can be used for hydrotreating and hydrocracking beds or stages, such as using hydrotreating conditions for both or using hydrocracking conditions for both. In yet another embodiment, the pressure for the hydrotreating and hydrocracking beds or stages can be the same.

Catalytic Dewaxing Process

At least a portion of the catalyst in one or more reaction stages, such as a final reaction stage, can be a dewaxing catalyst. At least one stage containing dewaxing catalyst can include a dewaxing catalyst bed located downstream from any hydrocracking catalyst stages and/or any hydrocracking catalyst present in a stage. This can allow the dewaxing to occur on molecules that have already been hydrotreated or hydrocracked to remove a significant fraction of organic sulfur- and nitrogen-containing species. The effluent from a reactor containing hydrotreating and/or hydrocracking catalyst, possibly after a gas-liquid separation, can be fed into a separate stage or reactor containing the dewaxing catalyst. Optionally, a portion of the dewaxing catalyst can be located in the same reactor as at least a portion of the hydrocracking catalyst in a stage.

Suitable dewaxing catalysts can include molecular sieves such as crystalline aluminosilicates (zeolites). In an embodiment, the molecular sieve can comprise, consist essentially of, or be ZSM-5, ZSM-22, ZSM-23, ZSM-35, ZSM-48, zeolite Beta, or a combination thereof, for example ZSM-23 and/or ZSM-48, or ZSM-48 and/or zeolite Beta. Optionally but preferably, molecular sieves that are selective for dewaxing by isomerization as opposed to cracking can be used, such as ZSM-48, zeolite Beta, ZSM-23, or a combination thereof. Additionally or alternately, the molecular sieve can comprise, consist essentially of, or be a 10-member ring 1-D molecular sieve. Examples include EU-1, ZSM-35 (or ferrierite), ZSM-11, ZSM-57, NU-87, SAPO-11, ZSM-48, ZSM-23, and ZSM-22. Preferred materials are EU-2, EU-11, ZBM-30, ZSM-48, or ZSM-23. ZSM-48 is most preferred. Note that a zeolite having the ZSM-23 structure with a silica to alumina ratio of from about 20:1 to about 40:1 can sometimes be referred to as SSZ-32. Other molecular sieves that are isostructural with the above materials include Theta-1, NU-10, EU-13, KZ-1, and NU-23. Optionally but preferably, the dewaxing catalyst can include a binder for the molecular sieve, such as alumina, titania, silica, silica-alumina, zirconia, or a combination thereof, for example alumina and/or titania or silica and/or zirconia and/or titania.

Preferably, the dewaxing catalysts used in processes according to the invention are catalysts with a suitable ratio of silica to alumina. For example, for ZSM-48, the ratio of silica to alumina in the zeolite can be less than about 200:1, such as less than about 110:1, or less than about 100:1, or less than about 90:1, or less than about 75:1. In various embodiments, the ratio of silica to alumina can be from 50:1 to 200:1, such as 60:1 to 160:1, or 70:1 to 100:1.

In various embodiments, the catalysts can further include a metal hydrogenation component. The metal hydrogenation component is typically a Group VI and/or a Group VIII metal. Preferably, the metal hydrogenation component is a Group VIII noble metal. Preferably, the metal hydrogenation component is Pt, Pd, or a mixture thereof. In an alternative embodiment, the metal hydrogenation component can be a combination of a non-noble Group VIII metal with a Group VI metal. Suitable combinations can include Ni, Co, or Fe with Mo or W, preferably Ni with Mo or W.

The metal hydrogenation component may be added to the catalyst in any convenient manner. One technique for adding the metal hydrogenation component is by incipient wetness. For example, after combining a zeolite and a binder, the combined zeolite and binder can be extruded into catalyst particles. These catalyst particles can then be exposed to a solution containing a suitable metal precursor. Alternatively, metal can be added to the catalyst by ion exchange, where a metal precursor is added to a mixture of zeolite (or zeolite and binder) prior to extrusion.

The amount of metal in the catalyst can be at least 0.1 wt % based on catalyst, or at least 0.15 wt %, or at least 0.2 wt %, or at least 0.25 wt %, or at least 0.3 wt %, or at least 0.5 wt % based on catalyst. The amount of metal in the catalyst can be 20 wt % or less based on catalyst, or 10 wt % or less, or 5 wt % or less, or 2.5 wt % or less, or 1 wt % or less. For embodiments where the metal is Pt, Pd, another Group VIII noble metal, or a combination thereof, the amount of metal can be from 0.1 to 5 wt %, preferably from 0.1 to 2 wt %, or 0.25 to 1.8 wt %, or 0.4 to 1.5 wt %. For embodiments where the metal is a combination of a non-noble Group VIII metal with a Group VI metal, the combined amount of metal can be from 0.5 wt % to 40 wt %, or 2 wt % to 35 wt %, or 5 wt % to 30 wt %.

The dewaxing catalysts useful in processes according to the invention can also include a binder. In some embodiments, the dewaxing catalysts used in process according to the invention are formulated using a low surface area binder, a low surface area binder represents a binder with a surface area of 100 $m^2/g$ or less, or 80 $m^2/g$ or less, or 70 $m^2/g$ or less. The amount of zeolite in a catalyst formulated using a binder can be from about 30 wt % zeolite to 90 wt % zeolite relative to the combined weight of binder and zeolite. Preferably, the amount of zeolite is at least about 50 wt % of the combined weight of zeolite and binder, such as at least about 60 wt % or from about 65 wt % to about 80 wt %.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture.

Effective dewaxing conditions can include a temperature of at least about 500° F. (260° C.), or at least about 550° F. (288° C.), or at least about 600° F. (316° C.), or at least about 650° F. (343° C.). Alternatively, the temperature can be about 800° F. (427° C.) or less, or 750° F. (399° C.) or less, or about 700° F. (371° C.) or less, or about 650° F. (343° C.) or less. The pressure can be at least about 250 psig (1.8 MPa), or at least about 500 psig (3.4 MPa), or at least about 750 psig (5.2 MPa), or at least about 1000 psig (6.9 MPa). Alternatively, the pressure can be about 5000 psig (34.6 MPa) or less, or about 3000 psig (20.7 MPa) or less, or about 1500 psig (10.3 MPa) or less, or about 1200 psig (8.2 MPa) or less, or about 1000 psig (6.9 MPa) or less, or about 800 psig (5.5 MPa) or less. The Liquid Hourly Space Velocity (LHSV) can be at least about 0.5 $hr^{-1}$, or at least about 1.0 $hr^{-1}$, or at least about 1.5 $hr^{-1}$. Alternatively, the LHSV can be about 10.0 $hr^{-1}$ or less, or about 5.0 $hr^{-1}$ or less, or about 3.0 $hr^{-1}$ or less, or about 2.0 $hr^{-1}$ or less. The treat gas rate can be at least about 500 scf/bbl (89 $Nm^3/m^3$), at least about 750 scf/bbl (134 $Nm^3/m^3$), or at least about 1000 scf/bbl (178 $Nm^3/m^3$). Alternatively, the treat gas rate can be about 10000 scf/bbl (1781 $Nm^3/m^3$) or less, or about 6000 scf/bbl (1069 $Nm^3/m^3$) or less, or about 4000 scf/bbl (712 $Nm^3/m^3$) or less, or about 2000 scf/bbl (356 $Nm^3/m^3$) or less, or about 1500 scf/bbl (267 $Nm^3/m^3$) or less.

As still another option, the dewaxing catalyst in the final reaction stage can be mixed with another type of catalyst, such as hydrocracking catalyst, in at least one bed in a reactor. As yet another option, a hydrocracking catalyst and a dewaxing catalyst can be co-extruded with a single binder to form a mixed functionality catalyst.

Hydrofinishing Process

In some aspects, one or more hydrofinishing stages (which can also be referred to as aromatic saturation stages in some instances) can also be provided. A hydrofinishing stage can be used, for example, for aromatic saturation and/or for improving product specifications, such as product color and polynuclear aromatic reduction. The one or more hydrofinishing stages can occur after the last dewaxing stage. Typically a hydrofinishing and/or aromatic saturation process will be performed in a separate reactor from dewaxing or hydrocracking processes for practical reasons, such as facilitating use of a lower temperature for the hydrofinishing or aromatic saturation process. However, an additional hydrofinishing reactor following a hydrocracking or dewaxing process but prior to fractionation could still be considered part of a second stage of a reaction system conceptually.

Hydrofinishing catalysts can include catalysts containing Group VI metals, Group VIII metals, and mixtures thereof. In an embodiment, preferred metals include at least one metal sulfide having a strong hydrogenation function. The mixture of metals may also be present as bulk metal catalysts where the amount of metal is about 30 wt % or greater based on catalyst. In another aspect, the hydrofinishing catalyst can include a Group VIII noble metal, such as Pt, Pd, or a combination thereof. The preferred hydrofinishing catalysts for aromatic saturation will comprise at least one metal having relatively strong hydrogenation function on a porous support. Typical support materials include amorphous or crystalline oxide materials such as alumina, silica, and silica-alumina. The support materials may also be modified, such as by halogenation, or in particular fluorination. The metal content of the catalyst is often as high as about 20-35 weight percent for non-noble metals. In an embodiment, a preferred hydrofinishing catalyst can include a crystalline material belonging to the M41S class or family of catalysts. The M41S family of catalysts are mesoporous materials having high silica content. Examples include MCM-41, MCM-48 and MCM-50. A preferred member of this class is MCM-41.

Hydrofinishing conditions can include temperatures from about 125° C. to about 425° C., preferably about 180° C. to about 280° C., a hydrogen partial pressure from about 500 psig (3.4 MPa) to about 3000 psig (20.7 MPa), preferably about 1500 psig (10.3 MPa) to about 2500 psig (17.2 MPa), and liquid hourly space velocity from about 0.1 $hr^{-1}$ to about 5 $hr^{-1}$ LHSV, preferably about 0.5 $hr^{-1}$ to about 1.5 $hr^{-1}$. Additionally, a hydrogen treat gas rate of from 36 $Nm^3/m^3$ to 1781 $Nm^3/m^3$ (200 SCF/B to 10,000 SCF/B) can be used.

After catalytic processing of the feedstock, the Group I base stock can be (optionally) added, and then the effluent can be fractionated. At least one fraction from the fractionation can correspond to a lubricant base stock having a viscosity index (VI) of at least 95, such as at least 105 or at least 110. The amount of saturated molecules in the at least one lubricant base stock fraction can be at least about 90%, while the sulfur content of the bottoms can be less than about 300 wppm. Thus, the at least one lubricant base stock fraction can be suitable for use as an API Group II or Group III lubricant base stock.

During fractionation, the temperature "cut points" for the fractionation can be selected to allow for production of one or more desired types of lubricant base stocks. For example, the fractionation cut points for the fractionator can be selected to generate lubricant base stock fractions with a desired viscosity, such as a light neutral base stock having a viscosity of 5.5 cSt or less at 100° C.; a medium neutral base stock having a viscosity of about 5.5 cSt to about 8 cSt at 100° C.; or a heavy neutral base stock having a viscosity of greater than about 8 cSt at 100° C. Additionally or alternately, the selection of fractionation cut points can also be made based on other considerations, such as producing a base stock with a desired volatility.

Production of Group I Base Stocks

In various aspects, the Group I base stock for addition to the catalytically processed feed can be from any convenient source. One option for providing the Group I base stock can be production of a Group I base stock by solvent processing of a vacuum gas oil, vacuum resid, or other suitable feed for formation of lubricant base stocks. Alternately, at least a portion of the processing for forming the Group I base stock can correspond to catalytic processing.

Depending on the type of feed used for solvent processing, an initial processing step can be solvent deasphalting. Solvent deasphalting can be used, for example, to separate asphaltenes from the remainder of a bottoms portion from an atmospheric or vacuum distillation. This results in a deasphalted fraction and an asphalt or asphaltene fraction.

Solvent deasphalting is a solvent extraction process. Typical solvents include alkanes or other hydrocarbons containing about 3 to about 6 carbons per molecule. Examples of suitable solvents include propane, n-butane, isobutene, and n-pentane. Alternatively, other types of solvents may also be suitable, such as supercritical fluids. During solvent deasphalting, a feed portion is mixed with the solvent. Portions of the feed that are soluble in the solvent are then extracted, leaving behind a residue with little or no solubility in the solvent. Typical solvent deasphalting conditions include mixing a feedstock fraction with a solvent in a weight ratio of from about 1:2 to about 1:10, such as about 1:8 or less. Typical solvent deasphalting temperatures range from about 40° C. to about 150° C. The pressure during solvent deasphalting can be from about 50 psig (345 kPag) to about 500 psig (3447 kPag).

The portion of the deasphalted feedstock that is extracted with the solvent is often referred to as deasphalted oil. In some aspects, the bottoms from a vacuum distillation can be used as the feed to the solvent deasphalter, so the portion extracted with the solvent can sometimes also be referred to as deasphalted bottoms. The yield of deasphalted oil from a solvent deasphalting process varies depending on a variety of factors, including the nature of the feedstock, the type of solvent, and the solvent extraction conditions. A lighter molecular weight solvent such as propane will result in a lower yield of deasphalted oil as compared to n-pentane, as fewer components of a bottoms fraction will be soluble in the shorter chain alkane. However, the deasphalted oil resulting from propane deasphalting is typically of higher quality, resulting in expanded options for use of the deasphalted oil. Under typical deasphalting conditions, increasing the temperature will also usually reduce the yield while increasing the quality of the resulting deasphalted oil. In various embodiments, the yield of deasphalted oil from solvent deasphalting can be about 70 wt % or less of the feed to the deasphalting process, or about 60 wt % or less. Preferably, the solvent deasphalting conditions are selected so that the yield of deasphalted oil is at least about 20 wt %, or at least about 30 wt % or at least about 35 wt %. The deasphalted bottoms oil from the solvent deasphalting procedure can then be combined with other fractions having a suitable boiling range for solvent processing to form a lubricant base stock.

Two types of solvent processing can be performed on a suitable feedstock, which can optionally include a portion of deasphalted oil. The first type of solvent processing is a solvent extraction to reduce the aromatics content and/or the amount of polar molecules. The solvent extraction process selectively dissolves aromatic components to form an aromatics-rich extract phase while leaving the more paraffinic components in an aromatics-poor raffinate phase. Naphthenes are distributed between the extract and raffinate phases. Typical solvents for solvent extraction include phenol, furfural and N-methyl pyrrolidone. By controlling the solvent to oil ratio, extraction temperature and method of contacting the distillate to be extracted with solvent, one can control the degree of separation between the extract and raffinate phases. Any convenient type of liquid-liquid extractor can be used, such as a counter-current liquid-liquid extractor. Depending on the initial concentration of aromatics in the feed, the raffinate phase can have an aromatics content of about 5 wt % to about 25 wt %. For typical feeds, the aromatics contents will be at least about 10 wt %.

The raffinate from the solvent extraction unit can then be solvent dewaxed under solvent dewaxing conditions to remove hard waxes from the raffinate. Additionally or alternately, the raffinate can be dewaxed by catalytic methods.

Solvent dewaxing typically involves mixing the raffinate feed from the solvent extraction unit with chilled dewaxing solvent to form an oil-solvent solution. Precipitated wax is thereafter separated by, for example, filtration. The temperature and solvent are selected so that the oil is dissolved by the chilled solvent while the wax is precipitated.

An example of a suitable solvent dewaxing process involves the use of a cooling tower where solvent is prechilled and added incrementally at several points along the height of the cooling tower. The oil-solvent mixture is agitated during the chilling step to permit substantially instantaneous mixing of the prechilled solvent with the oil. The prechilled solvent is added incrementally along the length of the cooling tower so as to maintain an average chilling rate at or below 10° F. per minute, usually between about 1 to about 5° F. per minute. The final temperature of the oil-solvent/precipitated wax mixture in the cooling tower will usually be between 0 and 50° F. (−17.8 to 10° C.). The mixture may then be sent to a scraped surface chiller to separate precipitated wax from the mixture.

Representative dewaxing solvents are aliphatic ketones having 3-6 carbon atoms such as methyl ethyl ketone and methyl isobutyl ketone, low molecular weight hydrocarbons such as propane and butane, and mixtures thereof. The solvents may be mixed with other solvents such as benzene, toluene or xylene.

In general, the amount of solvent added will be sufficient to provide a liquid/solid weight ratio between the range of 5/1 and 20/1 at the dewaxing temperature and a solvent/oil volume ratio between 1.5/1 to 5/1. The solvent dewaxed oil is typically dewaxed to an intermediate pour point, preferably less than about +10° C., such as less than about 5° C. or less than about 0° C. The resulting solvent dewaxed oil is suitable for use in forming one or more types of Group I base stocks. The aromatics content will typically be greater than 10 wt % in the solvent dewaxed oil. Additionally, the sulfur content of the solvent dewaxed oil will typically be greater than 300 wppm.

Group I base stocks can also be formed by catalytic dewaxing of the raffinate from a solvent extraction unit. Suitable dewaxing catalysts can include molecular sieves such as crystalline aluminosilicates (zeolites). Examples of suitable dewaxing catalysts can include, but are not limited to, ZSM-5, ZSM-11, ZSM-22, ZSM-23, ZSM-35, ZSM-48, zeolite Beta, or a combination thereof. Catalysts based on ZSM-5 are preferred for the production of Group I base stocks. In various embodiments, the dewaxing catalysts can optionally further include a metal hydrogenation component. The metal hydrogenation component is typically a Group VI and/or a Group VIII metal. Preferably the metal hydrogenation component can be a combination of a non-noble Group VIII metal with a Group VI metal. Suitable combinations can include Ni, Co, or Fe with Mo or W, preferably Ni with Mo or W.

For embodiments where the metal is a combination of a non-noble Group VIII metal with a Group VI metal, the combined amount of metal can be from 0.5 wt % to 40 wt %, or 2 wt % to 35 wt %, or 5 wt % to 30 wt %.

The dewaxing catalysts useful in processes according to the invention can also include a binder. The amount of zeolite in a catalyst formulated using a binder can be from about 30 wt % zeolite to 90 wt % zeolite relative to the combined weight of binder and zeolite. Preferably, the amount of zeolite is at least about 50 wt % of the combined weight of zeolite and binder, such as at least about 60 wt % or from about 65 wt % to about 80 wt %.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture.

Effective dewaxing conditions can include a temperature of at least about 500° F. (260° C.), or at least about 550° F. (288° C.), or at least about 600° F. (316° C.), or at least about 650° F. (343° C.). Alternatively, the temperature can be or less, or about 650° F. (343° C.) or less. For example, the dewaxing temperature can be about 600° F. (316° C.) to about 750° F. (399° C.), or about 650° F. (343° C.) to about 750° F. (399° C.), or about 650° F. (343° C.) to about 725° F. (385° C.), or about 650° F. (343° C.) to about 700° F. (371° C.), or about 675° F. (357° C.) to about 750° F. (399° C.), or about 700° F. (371° C.) to about 750° F. (399° C.). The pressure can be at least about 250 psig (1.8 MPa), or at least about 500 psig (3.4 MPa), or at least about 750 psig (5.2 MPa), or at least about 1000 psig (6.9 MPa). Alternatively, the pressure can be about 5000 psig (34.6 MPa) or less, or about 3000 psig (20.7 MPa) or less, or about 1500 psig (10.3 MPa) or less, or about 1200 psig (8.2 MPa) or less, or about 1000 psig (6.9 MPa) or less, or about 800 psig (5.5 MPa) or less. The Liquid Hourly Space Velocity (LHSV) can be at least about 0.5 $hr^{-1}$, or at least about 1.0 $hr^{-1}$, or at least about 1.5 $h^{-1}$. Alternatively, the LHSV can be about 10.0 $hr^{-1}$ or less, or about 5.0 $hr^{-1}$ or less, or about 3.0 $hr^{-1}$ or less, or about 2.0 $hr^{-1}$ or less. The treat gas rate can be at least about 500 scf/bbl (89 $Nm^3/m^3$), at least about 750 scf/bbl (134 $Nm^3/m^3$), or at least about 1000 scf/bbl (178 $Nm^3/m^3$). Alternatively, the treat gas rate can be about 10000 scf/bbl (1781 $Nm^3/m^3$) or less, or about 6000 scf/bbl (1069 $Nm^3/m^3$) or less, or about 4000 scf/bbl (712 $Nm^3/m^3$) or less, or about 2000 scf/bbl (356 $Nm^3/m^3$) or less, or about 1500 scf/bbl (267 $Nm^3/m^3$) or less.

Example of Configuration for Integrated Reaction System

FIG. 1 shows a schematic example of configuration for manufacturing lubricant base stocks. In the embodiment shown in FIG. 1, in addition to a process train for catalytic processing to form a Group II or Group III base stock, a separate solvent processing train is shown for forming a Group I base stock by solvent processing. A side stream of the Group I base stock can then be added to the catalytic processing train prior to fractionation.

In FIG. 1, a catalytic process train is represented as two stages of processing. An initial stage is a hydrotreatment and/or hydrocracking stage. After an optional separation to remove contaminant gases, a second stage consists first of a dewaxing step. After dewaxing, the dewaxed effluent can optionally be quenched. A second step in the processing stage can include one or more beds of hydrofinishing catalyst.

In FIG. 1, a first feedstock for lubricant base stock production 105 is introduced into a first stage 110 of a catalytic process train, while a second feedstock for lubricant base stock production 135 is introduced into a solvent processing train. Optionally, a feed containing aspahltenes 125 can be used in addition to or in place of second feedstock 135. The asphaltene-containing feed 125 is passed into a deasphalter 120 for solvent deasphalting. This results in an asphalt output 128 and a deasphalted oil stream 123. The feedstock 135 and/or deasphalted oil 123 are then solvent extracted 130. This results in an aromatics-rich extract 138 and a raffinate 143 with reduced aromatics content. The raffinate 143 is then dewaxed 140 to form a Group I base stock 145 and a secondary output 148. When dewaxing 140 corresponds to solvent dewaxing, the secondary output 148 can correspond to a wax output. Alternatively, if dewaxing 140 corresponds to a catalytic dewaxing process, the raffinate 143 can be catalytically dewaxed to produce a Group I base stock 145 and light fuel products 148. While not shown in FIG. 1, the Group I base stock may optionally be hydrofinished to remove color bodies and polar species. The Group I base stock can represent light neutral, medium neutral, and/or heavy neutral base stock. A side stream 175 can be withdrawn from the Group I base stock 145 for addition to the catalytic process train prior to fractionation. Optionally, solvent extraction process 130 and/or solvent dewaxing process 140 can represent a plurality of solvent extraction and/or dewaxing units. In such an option, multiple feeds can be solvent processed separately, allowing for separate production of multiple Group I base stocks.

For the catalytic process train shown in FIG. 1, a suitable feedstock is passed into first hydroprocessing stage 110. The hydroprocessing stage 110 can correspond to, for example, a hydrotreating stage, a hydrocracking stage, or a combination thereof. The effluent 115 from hydroprocessing stage 110 can optionally be passed through a separation stage, such as a gas-liquid separator 190 for removal of contaminant gases and light ends 198. Alternatively, the effluent 115 can be passed into a fractionator for separation of lower boiling fractions from the effluent, such as naphtha or distillate fuel fractions. The separated effluent 155 can then be passed into a second stage that includes a dewaxing process 150. As shown in FIG. 1, the effluent from dewaxing process 150 is passed into at least one heat exchanger 160. The cooled dewaxed effluent 173 from separator 160 is then passed into a hydrofinishing process 170. Exposing the feed to the hydrofinishing process 170 results in an effluent 183, which can be combined with the additional Group I base stock stream 173. The combination of effluent 183 from the hydrofinishing process 170 and the additional Group I base stock stream 173 is then separated using an atmospheric separator 180 to form, for example, at least a naphtha and light ends portion 188, a distillate fuel portion 186, and at least one lubricant base stock portion 185. This lubricant base stock portion corresponds to a Group II or Group III lubricant base stock.

EXAMPLES

In the following examples, a representative Group II base stock formed by catalytic processing is blended with various Group I base stocks to form a combined base stock or finished lubricant products. In these examples, various values are provided for the base stocks or combined products.

FIG. 2 shows several representative lubricant base stocks that are used in the Examples to illustrate modification of the aromatics content of a Group II base stock. In FIG. 2, the Group II light neutral (LN) represents the base stock to which the Group I stocks will be added. In practice, a Group II stock will typically not be a final base stock, but will be the non-fractionated effluent from the hydrofinishing reactor. However, the examples below are believed to be representative of the types of base stock and finished products that can be formed using the methods described herein.

FIG. 2 shows various properties for the example of a Group II Light Neutral (LN) base stock as well as two examples of a Group I LN base stock and two examples of a Group I Heavy Neutral (HN). All of the Group I base stocks in Table 1 were formed via solvent processing, although catalytically processed Group I base stocks are also believed to be suitable for use for increasing aromatics content. The Group II LN base stock was formed by catalytic processing. As shown in FIG. 2, the aromatics content of the Group I base stocks as inferred by UV absorbtivity is roughly 3 orders of magnitude greater than the aromatics content of the Group II LN base stock.

FIG. 3 provides base stock properties for blends of the Group II LN with 0.5 to 1.0 wt % of Group I base stocks. As shown in FIG. 3, blending 0.5 to 1.0 wt % of a Group I base stock resulted in only modest changes in key base stock properties, such as cold cranking simulator viscosity, Saybolt color, kinematic viscosity at 100° C., and viscosity index. While the key base stock properties of the various blends are not identical to the properties of the original Group II LN base stock, the differences in the values are not significant relative to desired commercial properties. However, the addition of the Group I base stock increased the aromatics content in the blended base stock as measured by UV absorbtivity at 226 nm. The blended base stocks in FIG. 3 demonstrate the ability to increase the aromatics content in a Group II base stock while otherwise substantially maintaining the properties of the base stock. The higher level of aromatics shown in the various blended base stocks demonstrates how the aromatics content can be modified during a processing run to reduce the variability of the aromatics content as catalyst(s) deactivate over time. For example, injection of 1.0 wt % of Group I LN A at the start of the catalyst cycle with the injection rate diminishing over time to zero would enable production of a final base stock aromatics at a constant level over a period of time. After the injection rate is diminished to zero, the processing run could be stopped, or the processing run could continue, with additional catalyst deactivation resulting in still higher aromatics content for subsequently produced final base stock.

FIG. 4 shows examples of forming a passenger car engine oil using the Group II LN base stock and 0.5 to 1.0 wt % of a Group I base stock. In FIG. 4, base stocks representing blends of the Group II LN with Group I stocks showed no detrimental low-temperature performance in a 5W-30 passenger car engine oil formulation as measured by pour point, CCS, Scanning Brookfield gel index, and MRV. In some aspects, a slight preference for using the Group I LN base stocks could exist because of their lower pour points of the Group I LN base stocks. However, as shown in FIG. 3, the blends involving the Group I HN base stocks also appear to provide an increased aromatics level without a detrimental impact on low temperature performance.

Figure 6:
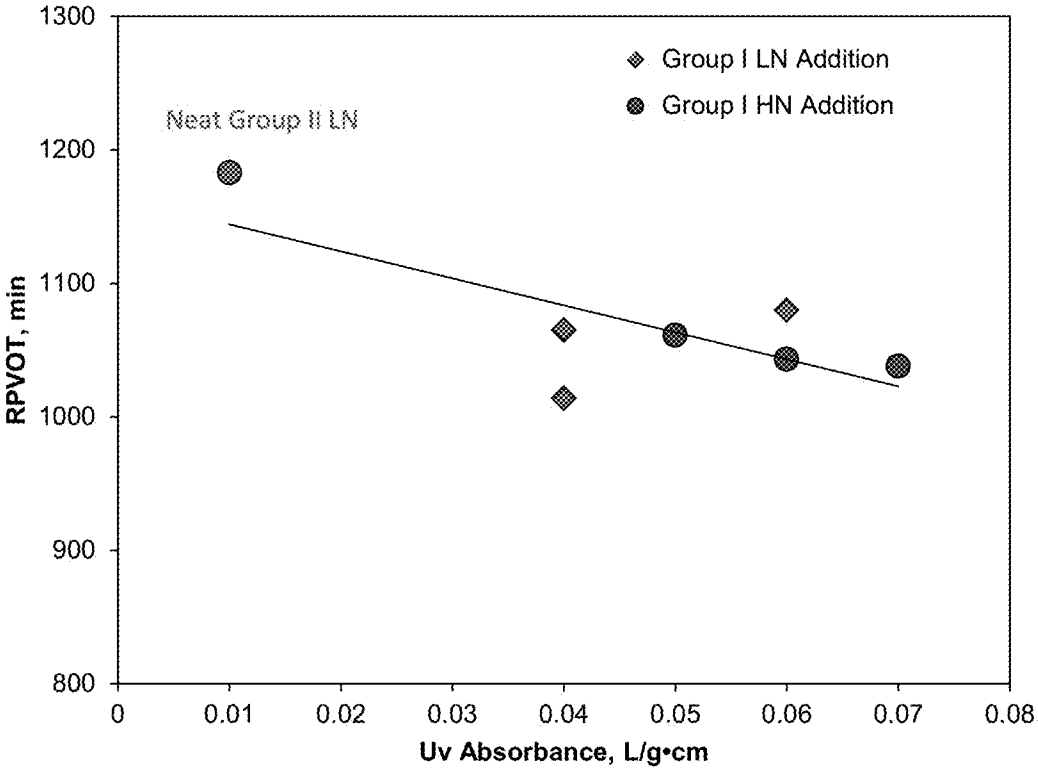
FIG. 6 shows oxidation test results of circulating oils formulated with base stocks of increasing aromatics content.

FIG. 5 shows examples of blending turbine oils (such as an ISO 32 turbine oil) using the Group II LN base stock and 0.5 to 1.0 wt % of a Group I base stock. FIG. 5 shows minimal or no impact to interfacial properties when Group I stocks are injected at low concentrations in a turbine oil formulation. There is an expected slight decline in oxidation stability of nominally 10% as measured by the RPVOT test (ASTM D2272). FIG. 6 shows the trend illustrating that the nature of the Group I stock added does not impact the final oxidation stability of the blend. As shown in FIG. 6, the addition Group I LN or Group I HN at 0.5-1.0 wt % into a Group II LN produces a base stock with consistent oxidation performance in a finished lubricant for a period of time after the start of the catalyst cycle.

Additional Embodiments

Embodiment 1

A method for forming a lubricant base stock having at least a threshold aromatics content during the course of a processing run, the method comprising: hydroprocessing a feedstock under first effective hydroprocessing conditions to form a hydroprocessed effluent; separating the hydroprocessed effluent to form at least a gas phase effluent and a liquid phase effluent; dewaxing at least a portion of the liquid phase effluent in the presence of a dewaxing catalyst under effective dewaxing conditions to form a dewaxed effluent; blending at least a portion of the dewaxed effluent with an aromatics-rich base stock to form an aromatics-enriched effluent, the aromatics-rich base stock comprising a Group I base stock, an alkylated aromatic base stock, or a combination thereof, the aromatics-enriched effluent containing about 0.25 wt % to about 1.25 wt % of the aromatics-rich base stock at a first time during the processing run; decreasing the amount of aromatics-rich base stock blended with the at least a portion of the dewaxed effluent at one or more times during the processing run subsequent to the first time; and fractionating at least a portion of the aromatics-enriched effluent to form at least a lubricant base stock product having a viscosity index of at least about 80 and a sulfur content of 300 wppm or less, wherein the lubricant base stock product at the first time during the processing run contains an amount of aromatics corresponding to at least an aromatics threshold amount, and wherein the lubricant base stock product at the one or more times during the processing run subsequent to the first time contains an amount of aromatics corresponding to at least the aromatics threshold amount.

Embodiment 2

The method of Embodiment 1, wherein the lubricant base stock product has a viscosity index of at least about 120.

Embodiment 3

The method of Embodiment 1, wherein the lubricant base stock product has a viscosity index of less than about 120.

Embodiment 4

The method of any of the above embodiments, wherein decreasing the amount of aromatics-rich base stock blended with the at least a portion of the dewaxed effluent at one or more times during the processing run subsequent to the first time comprises: stopping the blending of aromatics-rich base stock with the at least a portion of the dewaxed effluent at a second time during the processing run subsequent to the first time, the lubricant base stock product at the second time during the processing run containing an amount of aromatics corresponding to at least the aromatics threshold amount.

Embodiment 5

The method of any of the above embodiments, wherein decreasing the amount of aromatics-rich base stock blended with the at least a portion of the dewaxed effluent at one or more times during the processing run subsequent to the first time comprises blending less than about 0.25 wt % of the aromatics-rich base stock with the at least a portion of the dewaxed effluent at a time during the processing run subsequent to the first time.

Embodiment 6

The method of any of the above embodiments, further comprising hydrofinishing at least a portion of the dewaxed effluent to form a dewaxed and hydrofinished effluent, wherein blending at least a portion of the dewaxed effluent with the aromatics-rich base stock comprises blending at least a portion of the dewaxed and hydrofinished effluent with the aromatics-rich base stock.

Embodiment 7

The method of Embodiment 6, wherein an amount of aromatics in a lubricant base stock fraction of the dewaxed and hydrofinished effluent is at a maximum at a third time during the processing run subsequent to the first time, and wherein the aromatics threshold amount is at least about 10% of the amount of aromatics in the lubricant base stock fraction of the dewaxed and hydrofinished effluent at the third time, or at least about 20%, or at least about 30%, or at least about 50%, or at least about 70%, or at least about 90%.

Embodiment 8

The method of claim 7, wherein the aromatics threshold amount is about 100% or less of the amount of aromatics in the lubricant base stock fraction of the dewaxed and hydrofinished effluent at the third time, or about 90% or less, or about 70% or less, or about 50% or less.

Embodiment 9

The method of Embodiment 6, wherein an amount of aromatics in a lubricant base stock fraction of the dewaxed and hydrofinished effluent is at a maximum at a third time during the processing run subsequent to the first time, and wherein the aromatics threshold amount is at least about 70% of the amount of aromatics in the lubricant base stock fraction of the dewaxed and hydrofinished effluent at the third time, or at least about 80%, or at least about 90%, or at least about 100%, or at least about 105%.

Embodiment 10

The method of Embodiment 9, wherein the aromatics threshold amount is about 150% or less of the amount of aromatics in the lubricant base stock fraction of the dewaxed and hydrofinished effluent at the third time, or about 125% or less, or about 105% or less, or about 100% or less, or about 95% or less, or about 85% or less.

Embodiment 11

The method of any of the above embodiments, wherein the effective hydroprocessing conditions comprise effective hydrotreating conditions, the effective hydrotreating conditions comprising temperatures of about 200° C. to about 450° C., or about 315° C. to about 425° C.; pressures of about 250 psig (1.8 MPag) to about 5000 psig (34.6 MPag) or about 300 psig (2.1 MPag) to about 3000 psig (20.8 MPag); liquid hourly space velocities (LHSV) of about 0.1 $hr^{-1}$ to about 10 $hr^{-1}$; and treat gas rates of about 200 scf/B (35.6 $m^3/m^3$) to about 10,000 scf/B (1781 $m^3/m^3$), or about 500 (89 $m^3/m^3$) to about 10,000 scf/B (1781 $m^3/m^3$).

Embodiment 12

The method of any of the above embodiments, wherein the effective hydroprocessing conditions are effective for conversion of at least 20% of the portion of the combined feedstock boiling above 700° F. (371° C.) to a portion boiling below 700° F. (371° C.), or at least 30%, or at least 50%.

Embodiment 13

The method of any of the above embodiments, wherein the effective hydroprocessing conditions comprise exposing the feedstock to a hydrotreating catalyst, a hydrocracking catalyst, or a combination thereof under effective hydrotreating conditions, effective hydrocracking conditions, or a combination thereof, the hydrocracking catalyst optionally being USY, zeolite Beta, or a combination thereof.

Embodiment 14

The method of any of the above embodiments, wherein the feedstock has a T5 boiling point of at least about 650° F., or at least about 700° F., or wherein the feedstock has a T95 boiling point of about 1100° F. or less, or about 1000° F. or less, or a combination thereof.

Embodiment 15

The method of any of the above embodiments, wherein the effective dewaxing conditions comprise a temperature of about 260° C. to about 427° C., or about 288° C. to about 371° C.; a pressure of about 250 psig (1.8 MPag) to about 5000 psig (34.6 MPag), or about 500 psig (3.4 Mpag) to about 1500 psig (10.3 MPag); a liquid hourly space velocity (LHSV) of about 0.5 $hr^{-1}$ to about 10 $hr^{-1}$, or about 1.0 $hr^{-1}$ to about 5.0 $hr^{-1}$, and a treat gas rate of about 500 scf/B (89 $Nm^3/m^3$) to about 10,000 scf/B (1781 $Nm^3/m^3$), or about 1000 scf/B (178 $Nm^3/m^3$) to about 4,000 scf/B (712 $Nm^3/m^3$).

Embodiment 16

The method of any of Embodiments 6-15, wherein the effective hydrofinishing conditions comprise a temperatures from about 125° C. to about 425° C., or about 180° C. to about 280° C., a hydrogen partial pressure from about 500 psig (3.4 MPa) to about 3000 psig (20.7 MPa), or about 1500 psig (10.3 MPa) to about 2500 psig (17.2 MPa), a liquid hourly space velocity from about 0.1 $hr^{-1}$ to about 5 $hr^{-1}$ LHSV, or about 0.5 $hr^{-1}$ to about 1.5 $hr^{-1}$, and a treat gas rate of from 36 $Nm^3/m^3$ to 1781 $Nm^3/m^3$ (200 SCF/B to 10,000 SCF/B).

Embodiment 17

The method of any of the above embodiments, wherein the aromatics content of the lubricant base stock product or the lubricant base stock fraction of the dewaxed and hydrofinished effluent is determined based on UV absorbance at 226 nm.

Embodiment 18

A method for forming a lubricant base stock having at least a threshold aromatics content during the course of a processing run, the method comprising: hydroprocessing a feedstock under effective hydroprocessing conditions to form a hydroprocessed effluent; separating the hydroprocessed effluent to form at least a gas phase effluent and a liquid phase effluent; dewaxing at least a portion of the liquid phase effluent in the presence of a dewaxing catalyst under effective dewaxing conditions to form a dewaxed effluent; hydrofinishing at least a portion of the dewaxed effluent to form a dewaxed and hydrofinished effluent; blending at least a portion of the dewaxed and hydrofinished effluent with an aromatics-rich base stock to form an aromatics-enriched effluent, the aromatics-rich base stock comprising a Group I base stock, an alkylated aromatic base stock, or a combination thereof, the aromatics-enriched effluent containing about 0.5 wt % to about 1.0 wt % of the aromatics-rich base stock at a first time during the processing run; decreasing the amount of aromatics-rich base stock blended with the at least a portion of the dewaxed and hydrofinished effluent at one or more times during the processing run subsequent to the first time, the blending of the aromatics-rich base stock with the at least a portion of the dewaxed and hydrofinished effluent being stopped after the decreasing at the one or more times; and fractionating at least a portion of the aromatics-enriched effluent to form at least a lubricant base stock product having a viscosity index of at least about 80 and a sulfur content of 300 wppm or less, wherein the lubricant base stock product at the first time during the processing run contains an amount of aromatics corresponding to at least an aromatics threshold amount, wherein the lubricant base stock product at the one or more times during the processing run subsequent to the first time contains an amount of aromatics corresponding to at least the aromatics threshold amount, and wherein an amount of aromatics in a lubricant base stock fraction of the dewaxed and hydrofinished effluent is at a maximum at a second time during the processing run subsequent to the first time, the aromatics threshold amount being about 10% to about 90% of the amount of aromatics in the lubricant base stock fraction of the dewaxed and hydrofinished effluent at the second time.

Embodiment 19

A method for forming a lubricant base stock having at least a threshold aromatics content during the course of a processing run, the method comprising: hydroprocessing a feedstock under effective hydroprocessing conditions to form a hydroprocessed effluent; separating the hydroprocessed effluent to form at least a gas phase effluent and a liquid phase effluent; dewaxing at least a portion of the liquid phase effluent in the presence of a dewaxing catalyst under effective dewaxing conditions to form a dewaxed effluent; hydrofinishing at least a portion of the dewaxed effluent to form a dewaxed and hydrofinished effluent; blending at least a portion of the dewaxed and hydrofinished effluent with an aromatics-rich base stock to form an aromatics-enriched effluent, the aromatics-rich base stock comprising a Group I base stock, an alkylated aromatic base stock, or a combination thereof, the aromatics-enriched effluent containing about 0.5 wt % to about 1.0 wt % of the aromatics-rich base stock at a first time during the processing run; decreasing the amount of aromatics-rich base stock blended with the at least a portion of the dewaxed and hydrofinished effluent at one or more times during the processing run subsequent to the first time; and fractionating at least a portion of the aromatics-enriched effluent to form at least a lubricant base stock product having a viscosity index of at least about 80 and a sulfur content of 300 wppm or less, wherein the lubricant base stock product at the first time during the processing run contains an amount of aromatics corresponding to at least an aromatics threshold amount, wherein the lubricant base stock product at the one or more times during the processing run subsequent to the first time contains an amount of aromatics corresponding to at least the aromatics threshold amount, and wherein an amount of aromatics in a lubricant base stock fraction of the dewaxed and hydrofinished effluent is at a maximum at a second time during the processing run subsequent to the first time, the aromatics threshold amount being about 70% to about 150% of the amount of aromatics in the lubricant base stock fraction of the dewaxed and hydrofinished effluent at the second time.

Embodiment 20

A method according to any of the above embodiments, wherein the alkylated aromatic base stock comprises an alkylated naphthalene base stock, an alkylated benzene base stock, or a combination thereof.

Embodiment 21

A lubricant base stock product having a threshold amount of aromatics formed according to the method of any of the above embodiments.

Embodiment 22

A lubricant base stock product formed by the method comprising: hydroprocessing a feedstock under effective hydroprocessing conditions to form a hydroprocessed effluent; separating the hydroprocessed effluent to form at least a gas phase effluent and a liquid phase effluent; dewaxing at least a portion of the liquid phase effluent in the presence of a dewaxing catalyst under effective dewaxing conditions to form a dewaxed effluent; blending at least a portion of the dewaxed effluent with an aromatics-rich base stock to form an aromatics-enriched effluent, the aromatics-rich base stock comprising a Group I base stock, an alkylated aromatic base stock, or a combination thereof, the aromatics-enriched effluent containing about 0.25 wt % to about 1.25 wt % of the aromatics-rich base stock at a first time during the processing run; decreasing the amount of aromatics-rich base stock blended with the at least a portion of the dewaxed effluent at one or more times during the processing run subsequent to the first time; and fractionating at least a portion of the aromatics-enriched effluent to form at least a lubricant base stock product having a viscosity index of at least about 80 and a sulfur content of 300 wppm or less, wherein the lubricant base stock product at the first time during the processing run contains an amount of aromatics corresponding to at least an aromatics threshold amount, and wherein the lubricant base stock product at the one or more times during the processing run subsequent to the first time contains an amount of aromatics corresponding to at least the aromatics threshold amount.

Embodiment 23

The lubricant base stock product of Embodiment 21 or 22, wherein the alkylated aromatic base stock comprises an alkylated naphthalene base stock, an alkylated benzene base stock, or a combination thereof.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

What is claimed is:

1. A method for forming a lubricant base stock having at least a threshold aromatics content during the course of a processing run, the method comprising:

hydroprocessing a feedstock under effective hydroprocessing conditions to form a hydroprocessed effluent;

separating the hydroprocessed effluent to form at least a gas phase effluent and a liquid phase effluent;

dewaxing at least a portion of the liquid phase effluent in the presence of a dewaxing catalyst under effective dewaxing conditions to form a dewaxed effluent;

blending at least a portion of the dewaxed effluent with an aromatics-rich base stock to form an aromatics-enriched effluent, the aromatics-rich base stock comprising a Group I base stock, an alkylated aromatic base stock, or a combination thereof, the aromatics-enriched effluent containing about 0.25 wt % to about 1.25 wt % of the aromatics-rich base stock at a first time during the processing run;

decreasing the amount of aromatics-rich base stock blended with the at least a portion of the dewaxed effluent at one or more times during the processing run subsequent to the first time; and fractionating at least a portion of the aromatics-enriched effluent to form at least a lubricant base stock product having a viscosity index of at least about 80 and a sulfur content of 300 wppm or less, wherein the lubricant base stock product at the first time during the processing run contains an amount of aromatics corresponding to at least an aromatics threshold amount, and wherein the lubricant base stock product at the one or more times during the processing run subsequent to the first time contains an amount of aromatics corresponding to at least the aromatics threshold amount.

2. The method of claim 1, wherein the alkylated aromatic base stock comprises an alkylated naphthalene base stock, an alkylated benzene base stock, or a combination thereof.

3. The method of claim 1, wherein the lubricant base stock product has a viscosity index of at least about 120.

4. The method of claim 1, wherein the lubricant base stock product has a viscosity index of less than about 120.

5. The method of claim 1, wherein decreasing the amount of aromatics-rich base stock blended with the at least a portion of the dewaxed effluent at one or more times during the processing run subsequent to the first time comprises:

stopping the blending of aromatics-rich base stock with the at least a portion of the dewaxed effluent at a second time during the processing run subsequent to the first time, the lubricant base stock product at the second time during the processing run containing an amount of aromatics corresponding to at least the aromatics threshold amount.

6. The method of claim 1, wherein decreasing the amount of aromatics-rich base stock blended with the at least a portion of the dewaxed effluent at one or more times during the processing run subsequent to the first time comprises blending less than about 0.25 wt % of the aromatics-rich base stock with the at least a portion of the dewaxed effluent at a time during the processing run subsequent to the first time.

7. The method of claim 1, further comprising hydrofinishing at least a portion of the dewaxed effluent to form a dewaxed and hydrofinished effluent, wherein blending at least a portion of the dewaxed effluent with the aromatics-rich base stock comprises blending at least a portion of the dewaxed and hydrofinished effluent with the aromatics-rich base stock.

8. The method of claim 7, wherein an amount of aromatics in a lubricant base stock fraction of the dewaxed and hydrofinished effluent is at a maximum at a third time during the processing run subsequent to the first time, and wherein the aromatics threshold amount is at least about 10% of the amount of aromatics in the lubricant base stock fraction of the dewaxed and hydrofinished effluent at the third time.

9. The method of claim 7, wherein an amount of aromatics in a lubricant base stock fraction of the dewaxed and hydrofinished effluent is at a maximum at a third time during the processing run subsequent to the first time, and wherein the aromatics threshold amount is at least about 30% of the amount of aromatics in the lubricant base stock fraction of the dewaxed and hydrofinished effluent at the third time.

10. The method of claim 7, wherein an amount of aromatics in a lubricant base stock fraction of the dewaxed and hydrofinished effluent is at a maximum at a third time during the processing run subsequent to the first time, and wherein the aromatics threshold amount is at least about 70% of the amount of aromatics in the lubricant base stock fraction of the dewaxed and hydrofinished effluent at the third time.

11. The method of claim 7, wherein an amount of aromatics in a lubricant base stock fraction of the dewaxed and hydrofinished effluent is at a maximum at a third time during the processing run subsequent to the first time, and wherein the aromatics threshold amount is about 150% or less of the amount of aromatics in the lubricant base stock fraction of the dewaxed and hydrofinished effluent at the third time.

12. The method of claim 1, wherein the effective hydroprocessing conditions comprise effective hydrotreating conditions, the effective hydrotreating conditions comprising a temperature of about 200° C. to about 450° C.; a pressure of about 250 psig (1.8 MPag) to about 5000 psig (34.6 MPag); a liquid hourly space velocity (LHSV) of about 0.1 $hr^{-1}$ to about 10 $hr^{-1}$; and a treat gas rate of about 200 scf/B (35 $Nm^3/m^3$) to about 10,000 scf/B (1781 $Nm^3/m^3$).

13. The method of claim 1, wherein the effective hydroprocessing conditions are effective for conversion of at least 20% of the portion of the combined feedstock boiling above 700° F. (371° C.) to a portion boiling below 700° F. (371° C.).

14. The method of claim 1, wherein the effective hydroprocessing conditions comprise exposing the feedstock to a hydrotreating catalyst, a hydrocracking catalyst, or a combination thereof under effective hydrotreating conditions, effective hydrocracking conditions, or a combination thereof.

15. The method of claim 14, wherein the hydrocracking catalyst is USY, zeolite Beta, or a combination thereof.

16. The method of claim 1, wherein the feedstock has a T5 boiling point of at least about 650° F., a T95 boiling point of about 1100° F. or less, or a combination thereof.

17. The method of claim 1, wherein the effective dewaxing conditions comprise a temperature of 260° C. to 427° C.; a pressure of 250 psig (1.8 MPag) to 5000 psig (34.6 MPag); a liquid hourly space velocity (LHSV) of 0.5 $hr^{-1}$ to 10 $hr^{-1}$; and a treat gas rate of 500 scf/B (89 $Nm^3/m^3$) to 10,000 scf/B (1781 $Nm^3/m^3$).

18. A method for forming a lubricant base stock having at least a threshold aromatics content during the course of a processing run, the method comprising:

hydroprocessing a feedstock under effective hydroprocessing conditions to form a hydroprocessed effluent;

separating the hydroprocessed effluent to form at least a gas phase effluent and a liquid phase effluent;

dewaxing at least a portion of the liquid phase effluent in the presence of a dewaxing catalyst under effective dewaxing conditions to form a dewaxed effluent;

hydrofinishing at least a portion of the dewaxed effluent to form a dewaxed and hydrofinished effluent;

blending at least a portion of the dewaxed and hydrofinished effluent with an aromatics-rich base stock to form an aromatics-enriched effluent, the aromatics-rich base stock comprising a Group I base stock, an alkylated aromatic base stock, or a combination thereof, the aromatics-enriched effluent containing about 0.5 wt % to about 1.0 wt % of the aromatics-rich base stock at a first time during the processing run;

decreasing the amount of aromatics-rich base stock blended with the at least a portion of the dewaxed and hydrofinished effluent at one or more times during the processing run subsequent to the first time, the blending of the aromatics-rich base stock with the at least a portion of the dewaxed and hydrofinished effluent being stopped after the decreasing at the one or more times; and fractionating at least a portion of the aromatics-enriched effluent to form at least a lubricant base stock product having a viscosity index of at least about 80 and a sulfur content of 300 wppm or less, wherein the lubricant base stock product at the first time during the processing run contains an amount of aromatics corresponding to at least an aromatics threshold amount, wherein the lubricant base stock product at the one or more times during the processing run subsequent to the first time contains an amount of aromatics corresponding to at least the aromatics threshold amount, and wherein an amount of aromatics in a lubricant base stock fraction of the dewaxed and hydrofinished effluent is at a maximum at a second time during the processing run subsequent to the first time, the aromatics threshold amount being about 10% to about 90% of the amount of aromatics in the lubricant base stock fraction of the dewaxed and hydrofinished effluent at the second time.

19. A method for forming a lubricant base stock having at least a threshold aromatics content during the course of a processing run, the method comprising:

hydroprocessing a feedstock under effective hydroprocessing conditions to form a hydroprocessed effluent;

separating the hydroprocessed effluent to form at least a gas phase effluent and a liquid phase effluent;

dewaxing at least a portion of the liquid phase effluent in the presence of a dewaxing catalyst under effective dewaxing conditions to form a dewaxed effluent;

hydrofinishing at least a portion of the dewaxed effluent to form a dewaxed and hydrofinished effluent;

blending at least a portion of the dewaxed and hydrofinished effluent with an aromatics-rich base stock to form an aromatics-enriched effluent, the aromatics-rich base stock comprising a Group I base stock, an alkylated aromatic base stock, or a combination thereof, the aromatics-enriched effluent containing about 0.5 wt % to about 1.0 wt % of the aromatics-rich base stock at a first time during the processing run;

decreasing the amount of the aromatics-rich base stock blended with the at least a portion of the dewaxed and hydrofinished effluent at one or more times during the processing run subsequent to the first time; and fractionating at least a portion of the aromatics-enriched effluent to form at least a lubricant base stock product having a viscosity index of at least about 80 and a sulfur content of 300 wppm or less, wherein the lubricant base stock product at the first time during the processing run contains an amount of aromatics corresponding to at least an aromatics threshold amount, wherein the lubricant base stock product at the one or more times during the processing run subsequent to the first time contains an amount of aromatics corresponding to at least the aromatics threshold amount, and wherein an amount of aromatics in a lubricant base stock fraction of the dewaxed and hydrofinished effluent is at a maximum at a second time during the processing run subsequent to the first time, the aromatics threshold amount being about 70% to about 150% of the amount of aromatics in the lubricant base stock fraction of the dewaxed and hydrofinished effluent at the second time.

* * * * *